US011471360B2

(12) United States Patent
Katoh et al.

(10) Patent No.: US 11,471,360 B2
(45) Date of Patent: Oct. 18, 2022

(54) POWER ASSIST SUIT

(71) Applicant: JTEKT Corporation, Kariya (JP)

(72) Inventors: Yoshinobu Katoh, Toyohashi (JP); Kazuyoshi Ohtsubo, Chiryu (JP); Hiromichi Ohta, Kariya (JP); Kensaku Kogushi, Yamatokoriyama (JP); Akihisa Umetani, Nara (JP); Nobuaki Shibata, Kizugawa (JP); Yuki Kobayashi, Nara (JP)

(73) Assignee: JTEKT Corporation, Kariya (JP)

( * ) Notice: Subject to any disclaimer, the term of this patent is extended or adjusted under 35 U.S.C. 154(b) by 322 days.

(21) Appl. No.: 16/699,963

(22) Filed: Dec. 2, 2019

(65) Prior Publication Data

US 2020/0179218 A1 Jun. 11, 2020

(30) Foreign Application Priority Data

Dec. 10, 2018 (JP) ..... JP2018-230918
Dec. 10, 2018 (JP) ..... JP2018-230920

(51) Int. Cl.
*A61H 3/00* (2006.01)

(52) U.S. Cl.
CPC ..... *A61H 3/00* (2013.01); *A61H 2003/007* (2013.01); *A61H 2201/0176* (2013.01);
(Continued)

(58) Field of Classification Search
CPC ..... A61H 3/00; A61H 2003/007; A61H 2201/1454; A61H 2201/1614; A61H 2201/1619; A61H 2201/1623; A61H 2201/1628; A61H 2201/164; A61H 2201/165; A61H 2201/1664; A61H 2201/1676; A61H 2201/0196; A61H 2201/1207; A61H 1/0244; A61H 2001/0211; A61H 2001/0248;
(Continued)

(56) References Cited

U.S. PATENT DOCUMENTS 6,620,117 B1 * 9/2003 Johnson ..... A61H 1/005 601/84
8,894,591 B2 * 11/2014 Hiki ..... A61H 3/00 601/5

(Continued)

FOREIGN PATENT DOCUMENTS

JP 2009-178369 A 8/2009
JP 2015-208795 A 11/2015
JP 2018-149624 A 9/2018

*Primary Examiner* — Justine R Yu
*Assistant Examiner* — Benjamin M. Kusiak
(74) *Attorney, Agent, or Firm* — Oblon, McClelland, Maier & Neustadt, L.L.P.

(57) ABSTRACT

A power assist suit includes a harness worn at least around hips of a wearer, an assist unit, a power unit, and a bearing roller. The assist unit includes an arm and a thigh-worn part. A rail is provided at a part of the arm in a longitudinal direction. The rail includes channel-shaped parts extending along the longitudinal direction. The thigh-worn part is connected to sliding movable parts or integrated with at least a portion of the sliding movable parts. The bearing roller is disposed between each of the channel-shaped parts in the rail and each of inner wall surfaces of the sliding movable parts facing the respective channel-shaped parts.

6 Claims, 25 Drawing Sheets

(52) U.S. Cl.
CPC ..... *A61H 2201/1215* (2013.01); *A61H 2201/1454* (2013.01); *A61H 2201/1463* (2013.01); *A61H 2201/164* (2013.01); *A61H 2201/165* (2013.01); *A61H 2201/1614* (2013.01); *A61H 2201/1619* (2013.01); *A61H 2201/1623* (2013.01); *A61H 2201/1628* (2013.01); *A61H 2201/1652* (2013.01); *A61H 2201/1664* (2013.01); *A61H 2201/1676* (2013.01); *A61H 2201/5069* (2013.01); *A61H 2201/5097* (2013.01); *A61H 2205/088* (2013.01); *A61H 2205/108* (2013.01); *A61H 2230/625* (2013.01)

(58) Field of Classification Search
CPC ..... A61H 2001/0259; A61H 1/0237; A61H 1/024; A61H 1/0262; A61H 3/008; A61H 2201/1652; A61H 2201/16; A61H 2201/1645; A61H 2201/1261; A61H 1/00; A61H 1/02; B25J 9/0006; A63B 21/00178; A61F 5/01–0195; A61F 5/00; A61F 5/37; A61F 5/0102; A61F 5/0123; A61F 5/058; A61F 5/05841; A61F 5/0585; A41D 13/0007; A41D 13/046; A41D 13/086; A47D 15/005; A62B 35/00; A61B 34/30; A61B 17/62; A61B 17/64
USPC .... 601/5; 128/845, 846, 869, 870, 875, 882; 602/2, 5, 19, 23, 25–26, 60, 62
See application file for complete search history.

(56) References Cited

U.S. PATENT DOCUMENTS

| | | | | |
|---|---|---|---|---|
| 9,050,236 | B2 * | 6/2015 | Kudoh | A61H 1/024 |
| 2006/0052732 | A1 * | 3/2006 | Shimada | A61F 5/0102 602/5 |
| 2007/0184952 | A1 * | 8/2007 | Matsubara | A63B 21/00178 482/148 |
| 2010/0063424 | A1 * | 3/2010 | Kudoh | B25J 9/0006 601/35 |
| 2011/0172570 | A1 * | 7/2011 | Shimizu | A61H 3/00 601/35 |
| 2013/0217551 | A1 * | 8/2013 | Parnell | A63B 21/00178 482/141 |
| 2014/0024978 | A1 * | 1/2014 | Killian | A61H 3/00 601/33 |
| 2016/0184111 | A1 * | 6/2016 | Ikedo | A61H 3/00 623/27 |
| 2016/0206498 | A1 * | 7/2016 | Kazerooni | A61F 5/026 |
| 2017/0232279 | A1 * | 8/2017 | Strohman | A62B 35/0087 182/36 |
| 2017/0232617 | A1 * | 8/2017 | Tanibayashi | A61F 5/0102 248/205.1 |
| 2017/0360645 | A1 * | 12/2017 | Sodeyama | B25J 9/1045 |
| 2018/0200878 | A1 * | 7/2018 | Tsai | A61F 2/70 |
| 2021/0113415 | A1 * | 4/2021 | Seifert | A61H 3/00 |
| 2021/0369533 | A1 * | 12/2021 | Huang | A61H 1/0244 |

* cited by examiner

POWER ASSIST SUIT

INCORPORATION BY REFERENCE

The disclosure of Japanese Patent Application No. 2018-230918 filed on Dec. 10, 2018 and Japanese Patent Application No. 2018-230920 filed on Dec. 10, 2018, each including the specification, drawings and abstract, is incorporated herein by reference in its entirety.

BACKGROUND

Technical Field

The present disclosure relates to a power assist suit that assists a motion of the thighs relative to the hips of a wearer or a motion of the hips relative to the thighs of the wearer.

Description of Related Art

In recent years, power assist suits that reduce burden on the hips etc. of wearers are desired at various worksites including manufacturing, distribution, construction, agriculture, nursing-care, and rehabilitation.

One example is the motion assisting device disclosed by Japanese Patent Application Publication No. 2018-149624 (JP 2018-149624 A) that has: a (right) actuator and a (left) actuator disposed respectively on the right hip and the left hip of a wearer; a (right) leg belt and a (left) leg belt worn respectively around the right thigh and the left thigh of the wearer; a (right) arm coupling the (right) actuator and the (right) leg belt together; and a (left) arm coupling the (left) actuator and the (left) leg belt together. The (right) actuator assists swinging of the (right) thigh relative to the hip of the wearer through the (right) arm and the (right) leg belt, while the (left) actuator assists swinging of the (left) thigh relative to the hip of the wearer through the (left) arm and the (left) leg belt.

Another example is the motion assisting device disclosed by Japanese Patent Application Publication No. 2015-208795 (JP 2015-208795 A) that has a (right) actuator and a (left) actuator disposed respectively on the right hip and the left hip of a wearer, and a (right) thigh brace integrated with an arm and a (left) thigh brace integrated with an arm. The arm of the (right) thigh brace is connected to the (right) actuator, and the (right) actuator assists swinging (backward) of the (right) thigh relative to the hip of the wearer. The arm of the (left) thigh brace is connected to the (left) actuator, and the (left) actuator assists swinging (backward) of the (left) thigh relative to the hip of the wearer.

SUMMARY

With the (right) leg belt worn around and fixed to the (right) thigh of the wearer and the (left) leg belt worn around and fixed to the (left) thigh of the wearer, the structure of the motion assisting device described in JP 2018-149624 A does not allow the (right) leg belt and the (left) leg belt to slide in the longitudinal direction of the thighs. In the case where the position of a swinging axis of the (right) actuator and the position of a swinging axis of the (left) actuator do not coincide with the positions of the hip joints of the wearer, the distance from the (right) leg belt to the swinging axis of the (right) actuator and the distance from the (left) leg belt to the swinging axis of the (left) actuator vary with the swinging angle to which the (right) thigh swings forward or backward. It is disadvantageous that the (right) leg belt and the (left) leg belt cannot slide in the longitudinal direction of the thighs and therefore cannot follow this variation in distance. Also when the wearer opens his or her legs sideways, the distance from the (right) leg belt to the swinging axis of the (right) actuator and the distance from the (left) leg belt to the swinging axis of the (left) actuator vary with the angle of opening. It is disadvantageous that the (right) leg belt and the (left) leg belt cannot slide in the longitudinal direction of the thighs and therefore cannot follow this variation in distance either. When these leg belts cannot follow the variation in distance, assisting torque may not be efficiently transmitted. Moreover, these leg belts may be forcibly moved along the thighs of the wearer, causing the wearer to feel discomfort or pain.

Similarly, the motion assisting device described in JP 2015-208795 A has a disadvantage in that the (right) thigh brace and the (left) thigh brace cannot slide in the longitudinal direction of the thighs and therefore cannot follow the variation in distance. Thus, as with JP 2018-149624 A, assisting torque may not be efficiently transmitted, or the wearer may feel discomfort or pain.

The present disclosure can appropriately maintain a worn state of the thigh-worn parts worn on the thighs of a wearer in response to various motions of the thighs so as to efficiently transmit assisting torque.

An aspect of the present disclosure is a power assist suit. This power assist suit includes: a harness worn at least around hips of a wearer; an assist unit worn on the harness and a thigh of the wearer; a power unit configured to generate assisting torque to be transmitted to the assist unit; and a bearing roller. The assist unit is configured to assist a predetermined motion. The predetermined motion is at least either a motion of the thigh relative to the hips of the wearer or a motion of hips relative to the thigh of the wearer. The assist unit includes an arm that is configured to swing by the assisting torque and a thigh-worn part that is worn on the thigh of the wearer. The arm has an elongated shape extending from a side part of the hip of the wearer along a side part of the thigh of the wearer, and a rail is provided at a part of the arm in a longitudinal direction. The rail has an H-shape in cross section orthogonal to the longitudinal direction and includes channel-shaped parts extending along the longitudinal direction. The thigh-worn part is connected to sliding movable parts or integrated with at least a portion of the sliding movable parts. The sliding movable parts are configured to slide along the longitudinal direction of the rail. The bearing roller is disposed between each of the channel-shaped parts in the rail and each of inner wall surfaces of the sliding movable parts facing the respective channel-shaped parts, and is configured to reduce friction between the rail and the sliding movable parts.

In this configuration, the thigh-worn part worn on the thigh of the wearer can slide along the arm that extends from a side part of the hip of the wearer along a side part of the thigh of the wearer. Thus, even in a case such as when the arm swings with the position of the swinging axis thereof and the position of the hip joint of the wearer not coinciding with each other, or when the wearer opens his or her legs sideways, the thigh-worn part slides automatically to an appropriate position, so that assisting torque can be efficiently transmitted, and an appropriate worn state can be maintained without causing the wearer to feel discomfort or pain. In addition, friction and noise occurring during sliding of the thigh-worn part can be reduced by the bearing roller.

In the above power assist suit, two or more bearing rollers may be disposed along the longitudinal direction between each of the channel-shaped parts in the rail and each of the inner wall surfaces of the sliding movable parts facing the respective channel-shaped parts.

In this configuration, two or more bearing rollers are provided along the longitudinal direction of the rail, which can make the allowable turning angle of the thigh-worn part relative to the rail smaller than when one bearing roller is provided. Thus, the thigh-worn part that can slide relative to the rail can be maintained in a more stable posture.

In the above power assist suit, one bearing roller may be disposed between each of the channel-shaped parts in the rail and each of the inner wall surfaces of the sliding movable parts facing the respective channel-shaped parts.

In this configuration, one bearing roller is provided along the longitudinal direction of the rail, which can make the allowable turning angle of the thigh-worn part relative to the rail larger than when two or more bearing rollers are provided. Thus, in a situation where a posture of the thigh-worn part turned to a greater degree relative to the rail is preferred according to various motions of the thigh of the wearer, the thigh-worn part can turn automatically so as to appropriately follow the wearer's motion.

In the above power assist suit, the assist unit may include an idler pulley. The power unit may include a drive pulley and an actuator. The assisting torque generated by the actuator may be transmitted from the drive pulley to the idler pulley through a cable. A drive pulley shaft member forming a shaft of the drive pulley may be supported, inside the power unit, at both ends in a direction of a drive pulley rotational axis that is a rotational axis of the drive pulley.

In this configuration, the drive pulley is supported, inside the power unit, at both sides in the direction of the drive pulley rotational axis such that the drive pulley is supported with both ends fixed. Thus, in the case where one shaft member of the drive pulley is connected to a device such as an electric motor, a large-size bearing is not required to support the one shaft member and that device can be downsized. As a result, the power assist suit can be reduced in size and weight.

In the above power assist suit, the drive pulley and the idler pulley may be disposed such that the drive pulley rotational axis and an idler pulley rotational axis that is a rotational axis of the idler pulley are not parallel to each other.

In this configuration, the position and orientation of the drive pulley can be flexibly set without being constrained by the extension direction of the idler pulley rotational axis.

In the above power assist suit, the power unit may have a cable hole into which the cable drawn out of the drive pulley is inserted. A cable guide that guides the cable drawn out of the drive pulley to the cable hole in a straight line may be provided inside the power unit.

In this configuration, the cable drawn out of the drive pulley is guided by the cable guide to the cable hole in a straight line. Thus, the cable is not subjected to a force in a straining direction, so that a decrease in the assisting torque transmission efficiency, breakage of the cable, etc can be prevented.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
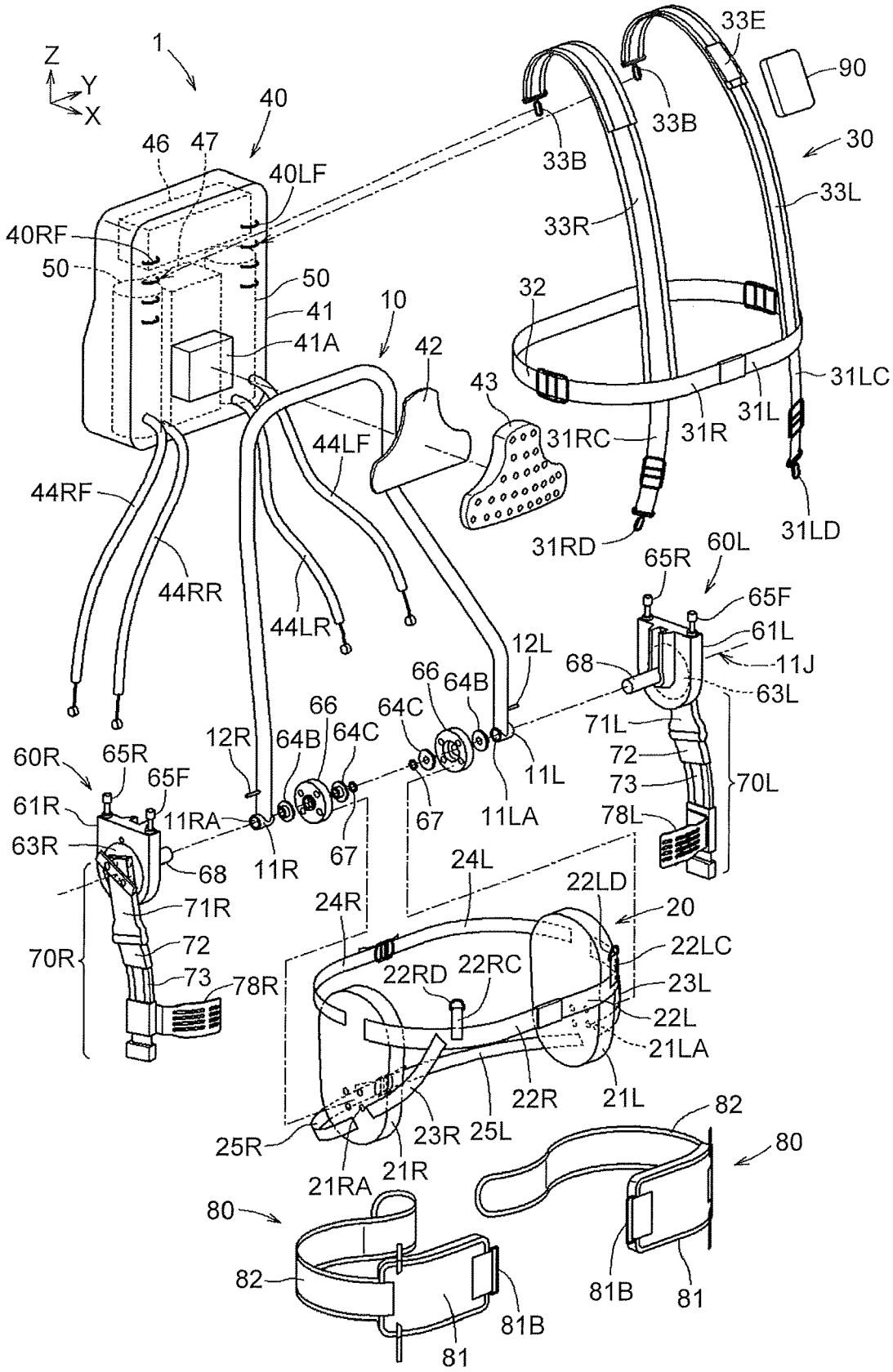
FIG. 1 is an exploded perspective view of a power assist suit as disassembled into parts.

The structure of a power assist suit 1 (see FIG. 2) will be described below. The power assist suit 1 is a device that assists turning of the thighs relative to the hips (or turning of the hips relative to the thighs) of a wearer when the wearer lifts a load (or puts down a load), or assists swinging of the thighs relative to the hips of the wearer during walking. The X-axis, Y-axis, and Z-axis in the drawings are orthogonal to one another, and as seen from the wearer wearing the power assist suit 1, the X-axis direction, Y-axis direction, and Z-axis direction correspond to a frontward direction, leftward direction, and upward direction, respectively. When the directions of up, down, left, right, front, and back are indicated in the following description, these directions refer to an upward direction (Z-axis direction), downward direction (the opposite direction from the Z-axis direction), leftward direction (Y-axis direction), rightward direction (the opposite direction from the Y-axis direction), frontward direction (X-axis direction), and backward direction (the opposite direction from the X-axis direction), respectively, as seen from the power assist suit 1.

Figure 2:
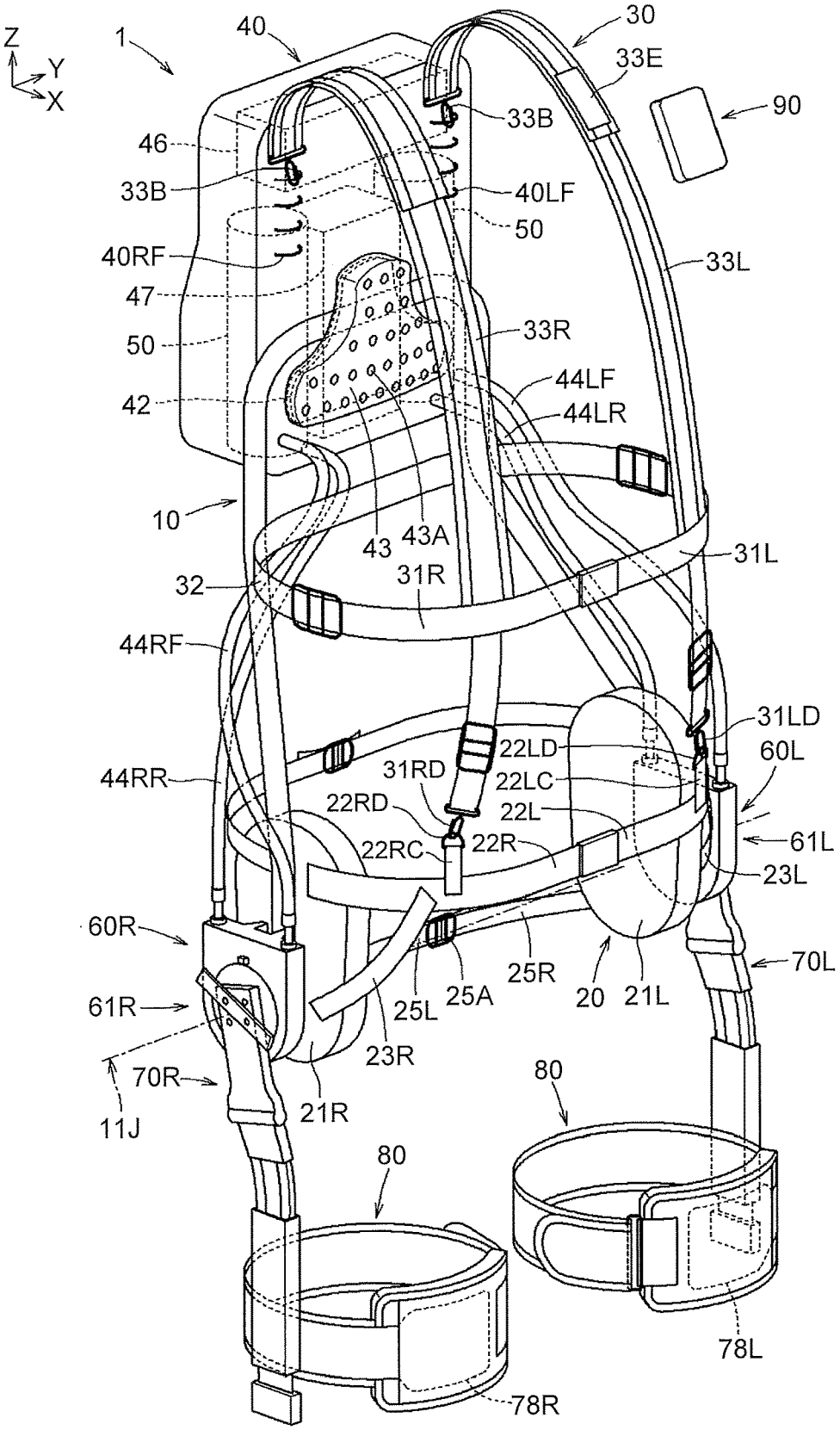
FIG. 2 is a perspective view of the power assist suit into which the parts shown in FIG. 1 have been assembled.
Figure 3:
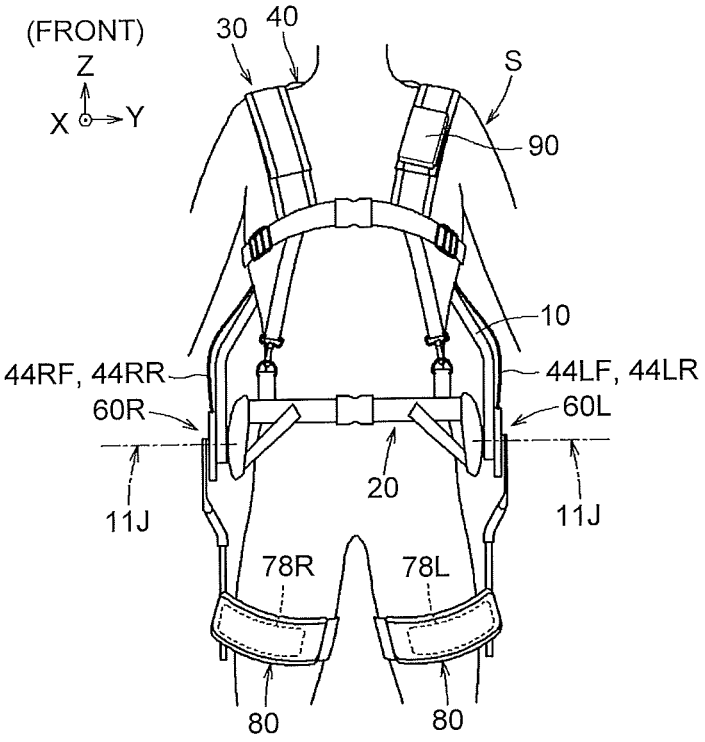
FIG. 3 is a front view of a state where a wearer is wearing the power assist suit.
Figure 4:
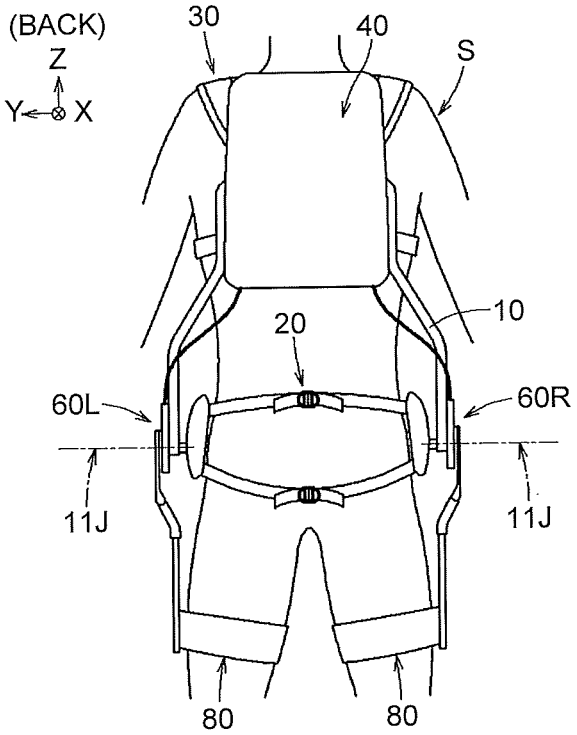
FIG. 4 is a back view of the state where the wearer is wearing the power assist suit.

First, the overall structure of the power assist suit 1 will be described using FIG. 1 and FIG. 2. FIG. 1 is an exploded perspective view showing parts composing the power assist suit 1, and FIG. 2 is a perspective view showing a state where the parts shown in FIG. 1 have been assembled into the power assist suit 1. FIG. 3 is a front view of a state where the wearer is wearing the power assist suit 1 shown in FIG. 2, and FIG. 4 is a back view of the state where the wearer is wearing the power assist suit 1 shown in FIG. 2.

As shown in the exploded perspective view of FIG. 1, the power assist suit 1 has a set of harness (a frame 10, a hip harness 20, a chest harness 30, and a thigh harness 80), a power unit 40, assist units 60R, 60L, a remote controller 90, etc. The thigh harness 80 may be omitted from the set of harness. In this case, the set of harness is composed of the hip harness 20, the chest harness 30, and the frame 10. The chest harness 30 can also be omitted, and in the case where the chest harness 30 is also omitted, the set of harness is composed of the hip harness 20 and the frame 10 and worn at least around the hips of the wearer. In the following, the remote controller 90, the frame 10, the hip harness 20, the chest harness 30, the power unit 40, the assist units 60R, 60L, and the thigh harness 80 will be described in this order.

The remote controller 90 includes: command input means for the wearer to give commands as to turning on and off of power supply to the power assist suit 1, selection of an operation mode, adjustment of the amount of assisting torque, adjustment of the timing of assisting torque, etc.; display means for displaying a state of a battery 47 inside the power unit 40, etc.; communication means for wirelessly sending and receiving information to and from a controller. A touch-and-close fastener (hook side) is provided on a rear surface of the remote controller 90, and the remote controller 90 is attached to a touch-and-close fastener 33E (loop side) provided on a shoulder belt 33L of the chest harness 30.

Figure 5:
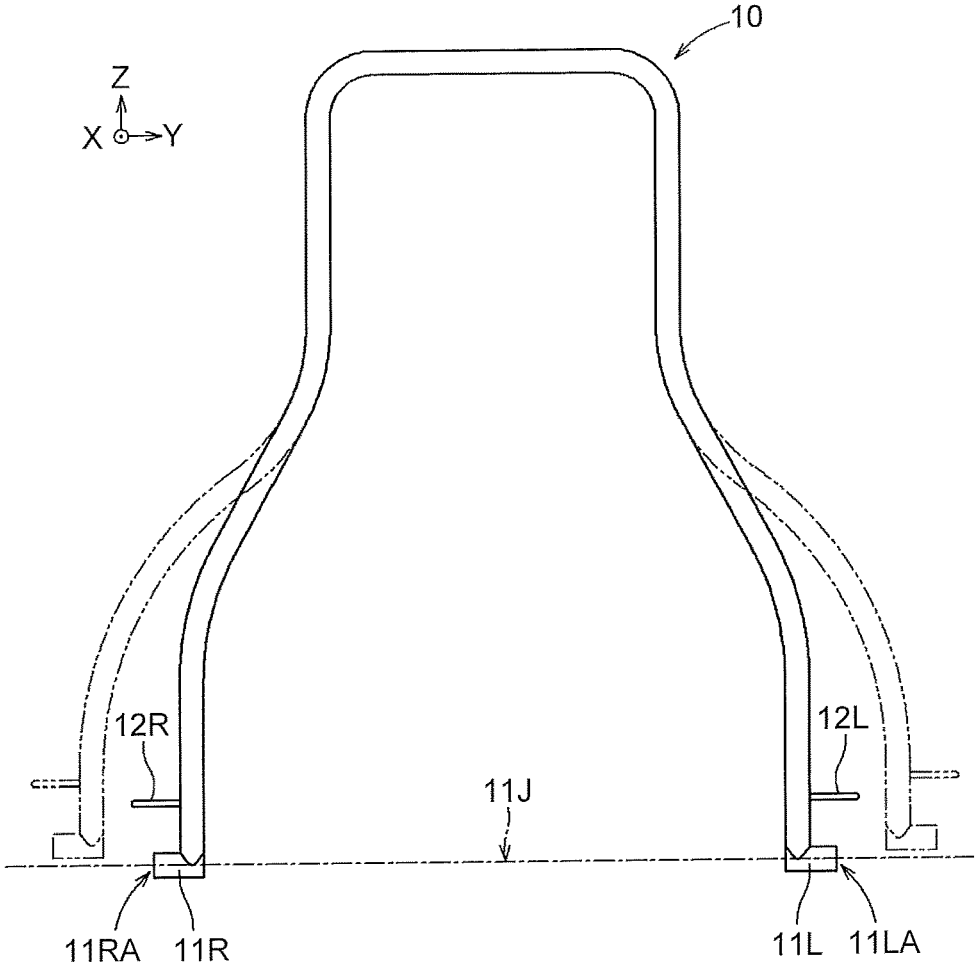
FIG. 5 is a front view of a frame.
Figure 6:
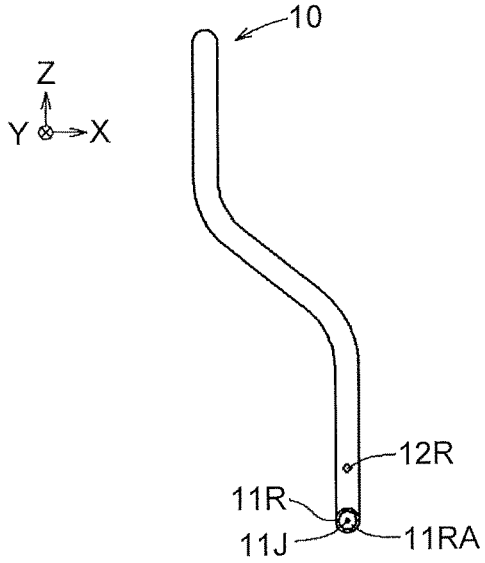
FIG. 6 is a side view of the frame.

FIG. 5 is a front view of the frame 10, and FIG. 6 is a side view of the frame 10. The frame 10 is formed by a metal pipe etc. (e.g., an aluminum pipe) capable of moderately elastically deforming (as indicated by the dotted lines in FIG. 5) according to the hip width of the wearer. At a lower right end of the frame 10, a tubular turning supporting portion 11R having a through-hole 11RA extending along an imaginary turning axis 11J is provided, and at a lower left end of the frame 10, a tubular turning supporting portion 11L having a through-hole 11LA extending along the imaginary turning axis 11J is provided. The imaginary turning axis 11J is located at the positions of the hip joints of the wearer wearing the power assist suit 1.

Above the turning supporting portion 11R, a stopper 12R protruding toward an outer side (in this case, the right side) is provided, and above the turning supporting portion 11L, a stopper 12L protruding toward an outer side (in this case, the left side) is provided. The stoppers 12L, 12R restrict the range of the turning angle of idler pulleys 63L, 63R of the assist units 60L, 60R (i.e., the range of the swinging angle of swinging arms 71L, 71R). This will be described in detail later in the description of the assist units 60L, 60R.

Figure 23:
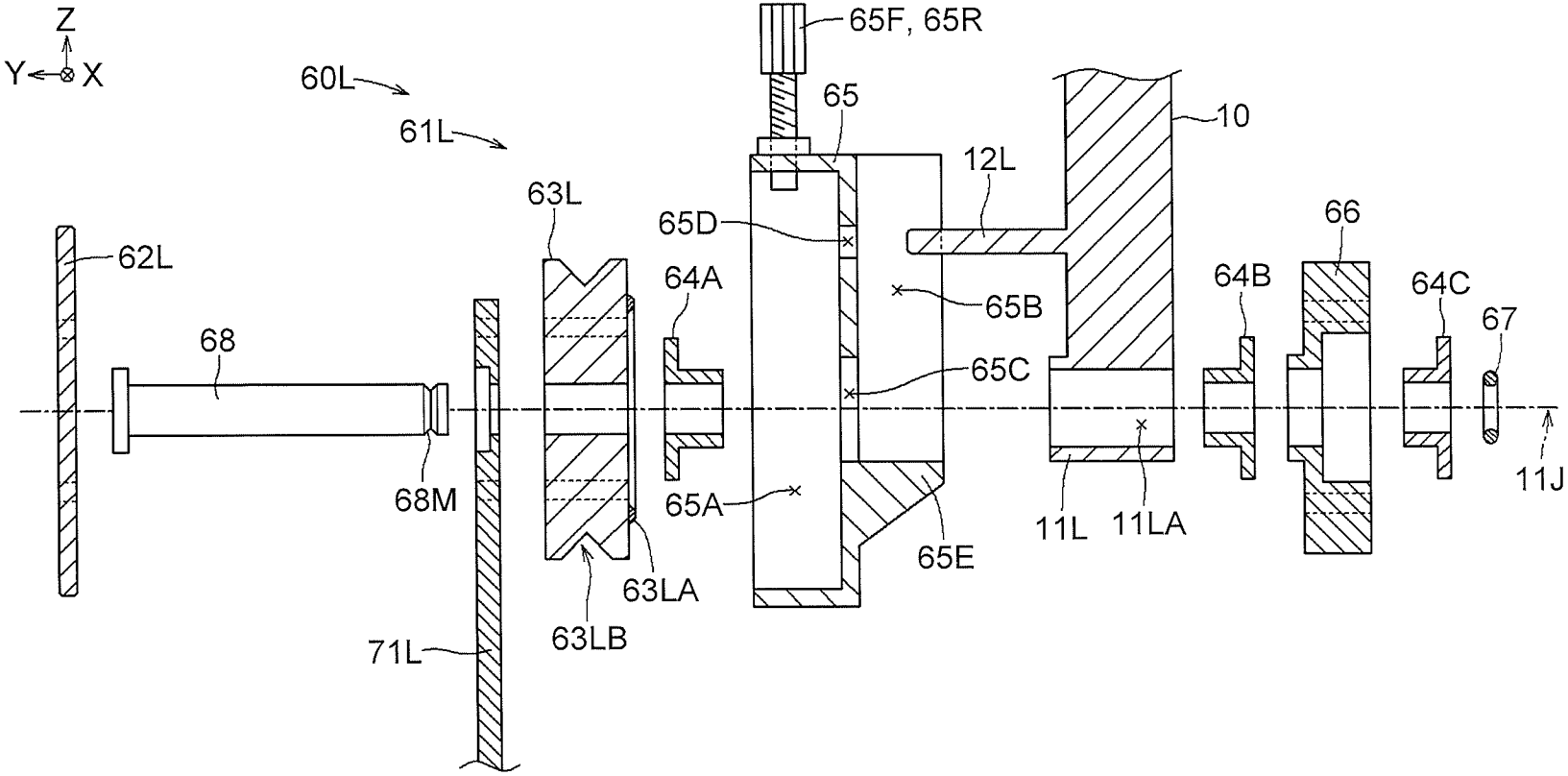
FIG. 23 is a view of the turning part shown in FIG. 21 as disassembled into parts.

As shown in FIG. 1 and FIG. 2, the frame 10 is fixed at an upper part to the power unit 40. As shown in FIG. 23, the assist unit 60L is connected with a shaft 68 inserted into the through-hole 11LA of the turning supporting portion 11L at the lower left end of the frame 10, and an adapter 64B, a coupling member 66, an adapter 64C, a slip-out preventing ring 67, etc. are mounted at a leading end of the shaft 68. As shown in FIG. 1, the coupling member 66 is fixed to a mounting hole 21LA of a hip side pad 21L. Similarly, the assist unit 60R is connected with a shaft 68 inserted into the through-hole 11RA of the turning supporting portion 11R at the lower right end of the frame 10, and an adapter 64B, a coupling member 66, an adapter 64C, a slip-out preventing ring 67, etc. are mounted at a leading end of the shaft 68. As shown in FIG. 1, the coupling member 66 is fixed to a mounting hole 21RA of a hip side pad 21R.

Figure 7:
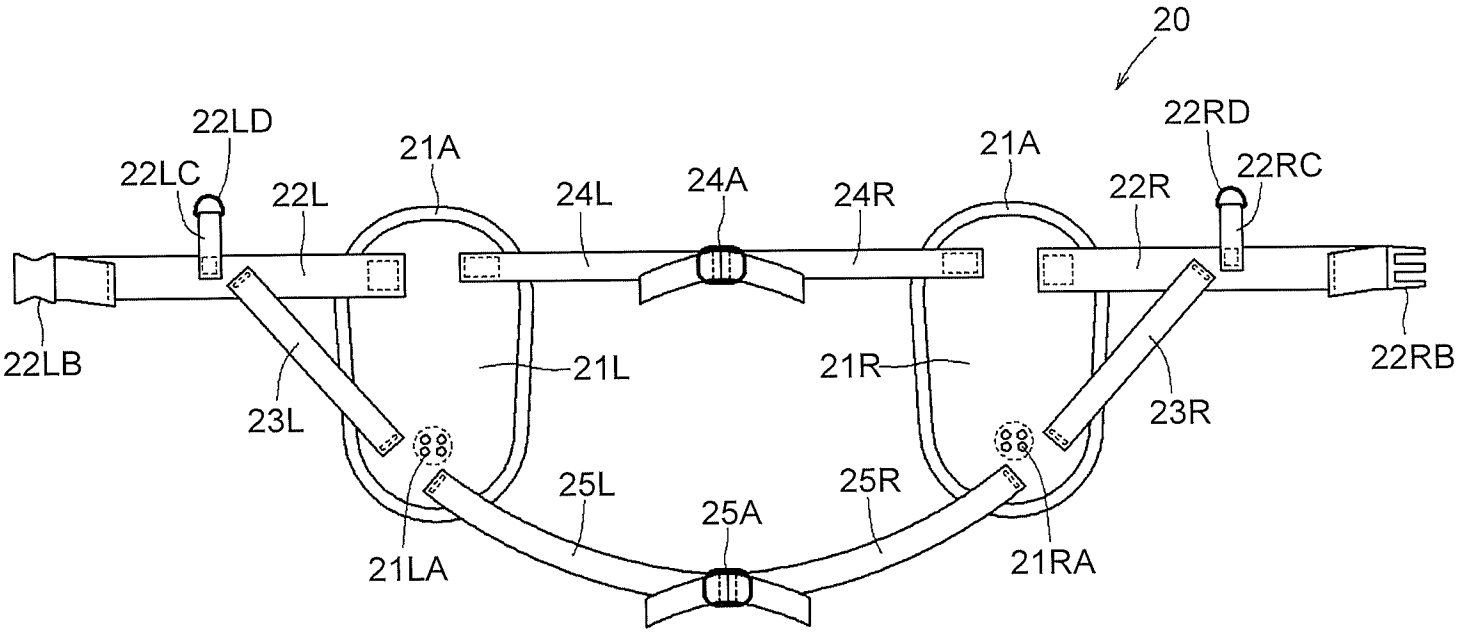
FIG. 7 is a view illustrating a hip harness.

FIG. 7 is a development of the hip harness 20. The hip harness 20 has the hip side pads 21L, 21R, front hip belts 22L, 22R, auxiliary hip belts 23L, 23R, upper back hip belts 24L, 24R, lower back hip belts 25L, 25R, etc. The hip harness 20 has the hip side pad 21L retained on the left hip of the wearer and the hip side pad 21R retained on the right hip of the wearer. As the coupling members 66 are retained on the imaginary turning axis 11J shown in FIG. 1, the mounting hole 21LA of the hip side pad 21L and the mounting hole 21RA of the hip side pad 21R connected to the coupling members 66 are retained around the imaginary turning axis 11J. The hip side pads 21L, 21R are formed, for example, by stacking layers of a three-dimensional mesh having elasticity, a formed sheet, and a nylon cloth from the wearer's side, and sewing these layers together so as to be integrated. Edges of the hip side pads 21L, 21R are covered with a tape-like member 21A made of cloth etc. and having an elongated shape, and the three-dimensional mesh, the foamed sheet, the nylon cloth, and the tape-like member 21A are sewn together so as to be integrated.

As shown in FIG. 7, one end side of the front hip belt 22L is fixed (sewn) to the hip side pad 21L, and a buckle 22LB that allows adjustment of the belt length and coupling and uncoupling of the belt is connected at the other end side. Similarly, one end side of the front hip belt 22R is fixed (sewn) to the hip side pad 21R, and a buckle 22RB that allows adjustment of the belt length and coupling and uncoupling of the belt is connected at the other end side.

One end side of a coupling hip belt 22LC extending upward is fixed (sewn) to an intermediate portion of the front hip belt 22L, and a coupler 22LD (e.g., a D-ring) is mounted at the other end side of the coupling hip belt 22LC. Similarly, one end side of a coupling hip belt 22RC extending upward is fixed (sewn) to an intermediate portion of the front hip belt 22R, and a coupler 22RD (e.g., a D-ring) is mounted at the other end side of the coupling hip belt 22RC. For example, the front hip belts 22L, 22R and the coupling hip belts 22LC, 22RC are resin-fiber belts, such as nylon belts.

As shown in FIG. 7, one end side of the auxiliary hip belt 23L is fixed (sewn) to the front hip belt 22L, and the other end side of the auxiliary hip belt 23L is fixed (sewn) to the hip side pad 21L. To stably maintain the coupling member 66 to be connected in position, the other end side of the auxiliary hip belt 23L is fixed near the mounting hole 21LA of the hip side pad 21L. Similarly, one end side of the auxiliary hip belt 23R is fixed (sewn) to the front hip belt 22R, and the other end side of the auxiliary hip belt 23R is fixed (sewn) to the hip side pad 21R. To stably maintain the coupling member 66 to be connected in position, the other end side of the auxiliary hip belt 23R is fixed near the mounting hole 21RA of the hip side pad 21R. For example, the auxiliary hip belts 23L, 23R are resin-fiber belts, such as nylon belts.

As shown in FIG. 7, one end side of the upper back hip belt 24L is fixed (sewn) to the hip side pad 21L, and the other end side is connected to a coupler-adjuster 24A that allows adjustment of the belt length. Similarly, one end side of the upper back hip belt 24R is fixed (sewn) to the hip side pad 21R, and the other end side is connected to the coupler-adjuster 24A that allows adjustment of the belt length. For example, the upper back hip belts 24L, 24R are resin-fiber belts, such as nylon belts.

As shown in FIG. 7, one end side of the lower back hip belt 25L is fixed (sewn) to the hip side pad 21L, and the other end side is connected to a coupler-adjuster 25A that allows adjustment of the belt length. Similarly, one end side of the lower back hip belt 25R is fixed (sewn) to the hip side pad 21R, and the other end side is connected to the coupler-adjuster 25A that allows adjustment of the belt length. For example, the lower back hip belts 25L, 25R are stretchable rubber belts. To stably maintain the coupling member 66 to be connected in position, the one end side of the lower back hip belt 25L is fixed near the mounting hole 21LA of the hip side pad 21L. Similarly, to stably maintain the coupling member 66 to be connected in position, the one end side of the lower back hip belt 25R is fixed near the mounting hole 21RA of the hip side pad 21R. The lower back hip belts 25L, 25R can come into contact with the buttocks of a wearer S in a state of being connected to each other by the coupler-adjuster 25A (see FIG. 4).

Figure 8:
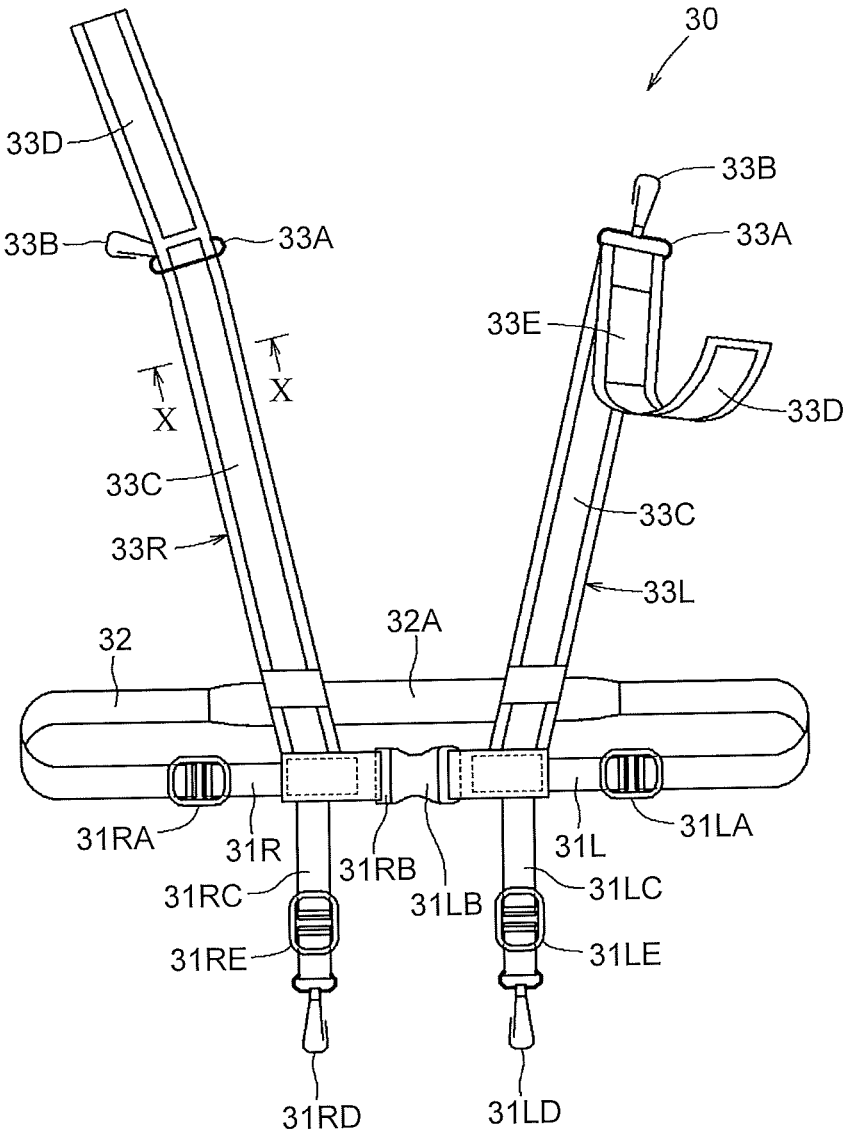
FIG. 8 is a view illustrating a chest harness.
Figure 9:
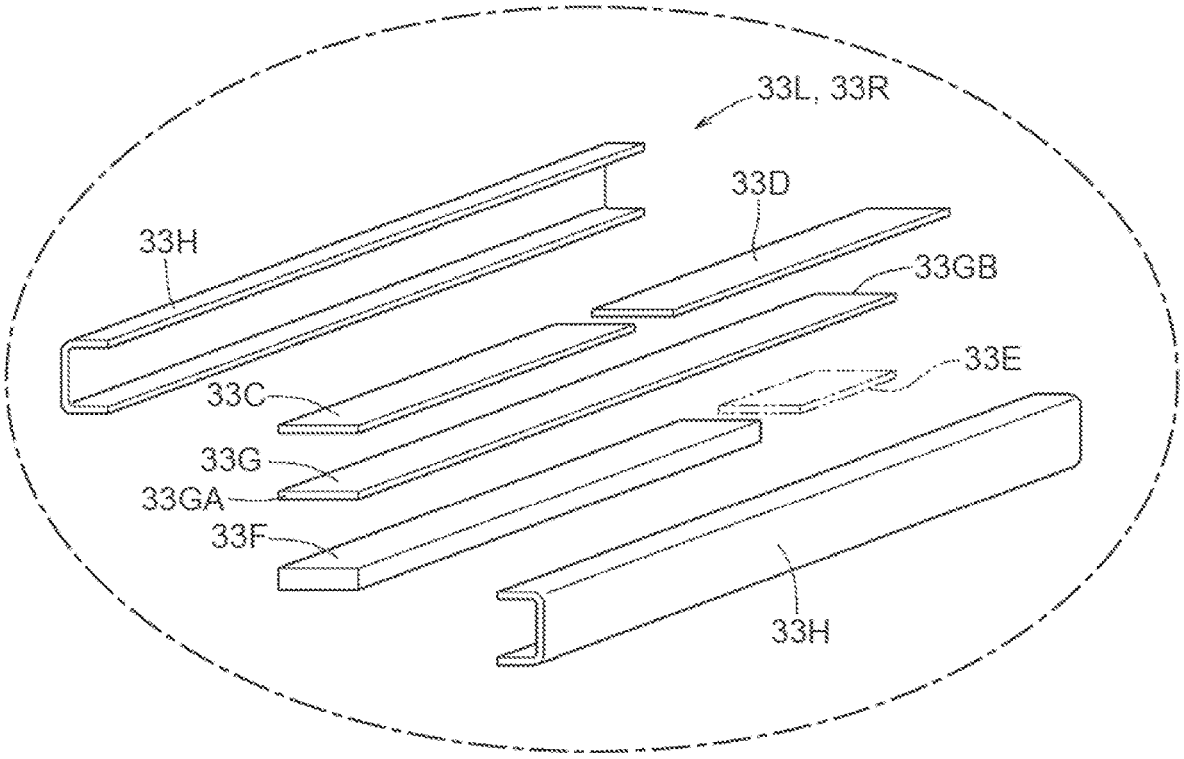
FIG. 9 is an exploded perspective view illustrating the structure of a shoulder belt.
Figure 10:
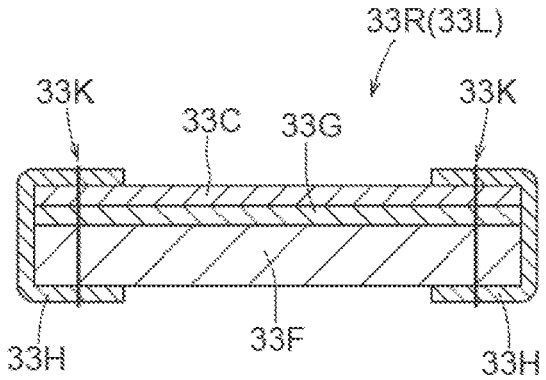
FIG. 10 is a sectional view illustrating the structure of the shoulder belt.

FIG. 8 is a front view of the chest harness 30. FIG. 9 is an exploded perspective view of parts composing a shoulder belt 33R, and FIG. 10 is a sectional view of the shoulder belt 33R. The chest harness 30 has front chest belts 31L, 31R, a back chest belt 32, the shoulder belts 33L, 33R, etc.

As shown in FIG. 8, one end side of the front chest belt 31L is connected to a buckle 31LB that allows adjustment of the belt length and coupling and uncoupling of the belt, and the other end side is connected to a coupler-adjuster 31LA that allows adjustment of the belt length. Similarly, one end side of the front chest belt 31R is connected to a buckle 31RB that allows adjustment of the belt length and coupling and uncoupling of the belt, and the other end side is connected to a coupler-adjuster 31RA that allows adjustment of the belt length.

One end side of a coupling chest belt 31LC extending downward is fixed (sewn) to an intermediate portion of the front chest belt 31L, and a coupler 31LD (e.g., a snap hook) is mounted at the other end side of the coupling chest belt 31LC. An adjuster 31LE that allows adjustment of the belt length is provided on the coupling chest belt 31LC. Similarly, one end side of a coupling chest belt 31RC extending downward is fixed (sewn) to an intermediate portion of the front chest belt 31R, and a coupler 31RD (e.g., a snap hook) is mounted at the other end side of the coupling chest belt 31RC. An adjuster 31RE that allows adjustment of the belt length is provided on the coupling chest belt 31RC. For example, the front chest belts 31L, 31R and the coupling chest belts 31LC, 31RC are resin-fiber belts, such as nylon belts.

As shown in FIG. 1, the coupler 31LD mounted on the coupling chest belt 31LC is coupled to the coupler 22LD mounted on the coupling hip belt 22LC, and the coupler 31RD mounted on the coupling chest belt 31RC is coupled to the coupler 22RD mounted on the coupling hip belt 22RC.

As shown in FIG. 8, one end side of the back chest belt 32 is connected to the coupler-adjuster 31LA, and the other end side is connected to the coupler-adjuster 31RA. For example, the back chest belt 32 is a resin-fiber belt, such as a nylon belt, and a wide part 32A at which the belt width is increased is provided at a central part of the back chest belt 32 in a longitudinal direction.

As shown in FIG. 8, one end side of the shoulder belt 33L is fixed (sewn) to an intermediate portion of the front chest belt 31L, and the other end side is inserted into a ring 33A provided with a coupler 33B (e.g., a snap hook). The shoulder belt 33L is turned back at the ring 33A, and the opposite parts of the shoulder belt 33L are attached to each other by touch-and-close fasteners 33C, 33D. The touch-and-close fastener 33C (loop side) is mounted at the side of the shoulder belt 33L closer to the front chest belt 31L (one end side) in a longitudinal direction, and the touch-and-close fastener 33D (hook side) is mounted at the side of the shoulder belt 33L farther away from the front chest belt 31L (other end side) in the longitudinal direction (see FIG. 9). The touch-and-close fastener 33E (loop side) to which the remote controller 90 (see FIG. 1) is attached is mounted on a surface of the shoulder belt 33L that is exposed as the shoulder belt 33L is turned back at the ring 33A.

Similarly, one end side of the shoulder belt 33R is fixed (sewn) to an intermediate portion of the front chest belt 31R, and the other end side is inserted into a ring 33A provided with a coupler 33B. The shoulder belt 33R is turned back at the ring 33A, and the opposite parts of the shoulder belt 33R are attached to each other by touch-and-close fasteners 33C, 33D. The touch-and-close fastener 33C (loop side) is mounted at the side of the shoulder belt 33R closer to the front chest belt 31R (one end side) in a longitudinal direction, and the touch-and-close fastener 33D (hook side) is mounted at the side of the shoulder belt 33R farther away from the front chest belt 31R (other end side) in the longitudinal direction (see FIG. 9). The shoulder belt 33R is different from the shoulder belt 33L in that the touch-and-close fastener 33E (loop side) is not mounted on a surface of the shoulder belt 33R that is exposed as the shoulder belt 33L is turned back at the ring 33A.

As shown in FIG. 1, the coupler 33B mounted on the shoulder belt 33L is coupled to one of a plurality of couplers 40LF (e.g., hooks) provided in the power unit 40, and the coupler 33B mounted on the shoulder belt 33R is coupled to one of a plurality of couplers 40RF (e.g., hooks) provided in the power unit 40. For example, the couplers 40RF (e.g., hooks) may be provided at an upper part of the frame 10, so that the couplers 33B can be coupled thereto.

Next, the structures of the shoulder belts 33L, 33R will be described using FIG. 9 and FIG. 10. As shown in FIG. 9, the shoulder belts 33L, 33R are each formed by stacking layers of a three-dimensional mesh 33F, a nylon cloth 33G the touch-and-close fastener 33C (loop side), and the touch-and-close fastener 33D (hook side), covering edges of the belt with tape-like members 33H, and then sewing these layers together at sewing positions 33K (see FIG. 10) so as to be integrated.

The three-dimensional mesh 33F (e.g., the honeycomb structure with type designation SK1145W manufactured by Unitika Technos, Ltd.) is shaped to extend in a longitudinal direction and has a predetermined width (e.g., a width of about 20 mm to 70 mm) and a predetermined thickness (e.g., a thickness of about 2 mm to 10 mm, preferably about 5 mm). Having elasticity and a fast-drying property, the three-dimensional mesh 33F is disposed on the side of the wearer's body and serves as a cushion.

Thus, air can be circulated around the body in contact with the three-dimensional mesh 33F. As this keeps the humidity between the shoulder belts 33L, 33R and the body from rising, the feeling of coolness can be enhanced, and an unpleasant feeling, such as hotness, can be mitigated when the wearer performs work that involves repeatedly assuming a stooping posture and an upright standing posture for long hours. Since the three-dimensional mesh 33F has sufficient cavities inside, the restoring force of the three-dimensional mesh 33F upon deformation can be maintained by applying only a small force. The three-dimensional mesh 33F quickly restores its original form when an external force having been applied thereto is removed. Therefore, when coming into contact with the body, the three-dimensional mesh 33F disposed at the body side of the shoulder belts 33L, 33R deforms easily so as to follow the shape of the body, which can enhance the adhesion of the shoulder belts 33L, 33R to the body so as to reduce the transmission loss of assisting force.

The nylon cloth 33G (e.g., the product with type designation A4400-Y24 and a mass of 194 g/m$^2$ manufactured by Masuda Co., Ltd.) is longer than the three-dimensional mesh 33F in the longitudinal direction, and is made of resin fibers etc. The nylon cloth 33G is shaped to extend in the longitudinal direction and has a predetermined width (e.g., a width of about 20 mm to 70 mm) and a predetermined thickness (e.g., a thickness of about 2 mm or less). The touch-and-close fastener 33C (loop side) (e.g., the product with type designation 2QM (loop side) manufactured by YKK Corporation) substantially equal in length to the three-dimensional mesh 33F is laid over the nylon cloth 33G, from the side of one end 33GA of the nylon cloth 33G toward the other end 33 GB thereof. The touch-and-close fastener 33C (loop side) is shaped to extend in the longitudinal direction and has a predetermined width (e.g., a width of about 20 mm to 70 mm) and a predetermined thickness (e.g., a thickness of about 1 mm to 3 mm, preferably about 2 mm).

The touch-and-close fastener 33D (hook side) (e.g., the product with type designation 1QN (hook side) manufactured by YKK Corporation) is laid over the nylon cloth 33G, from the other end 33 GB of the nylon cloth 33G toward the one end 33GA thereof. The touch-and-close fastener 33D (hook side) is shaped to extend in the longitudinal direction and has a predetermined width (e.g., a width of about 20 mm to 70 mm) and a predetermined thickness (e.g., a thickness of about 1 mm to 3 mm, preferably about 2 mm). Here, the touch-and-close fastener 33C (loop side) functions as an example of the loop-side fastener. The touch-and-close fastener 33D (hook side) functions as an example of the hook-side fastener.

The touch-and-close fastener 33E (loop side) (e.g., the product with type designation 2QM (loop side) manufactured by YKK Corporation) to which the remote controller 90 (see FIG. 1) is attached is mounted on the nylon cloth 33G of the shoulder belt 33L for the left shoulder, at the side opposite from the touch-and-close fastener 33D (hook side). The touch-and-close fastener 33E (loop side) is shaped to extend in the longitudinal direction and has a predetermined width (e.g., a width of about 20 mm to 70 mm) and a predetermined thickness (e.g., a thickness of about 1 mm to 3 mm, preferably about 2 mm).

The tape-like member 33H is shaped to extend in the longitudinal direction and has a predetermined width (e.g., a width of about 20 mm to 70 mm) and a predetermined thickness (e.g., a thickness of about 2 mm or less). Thus, the three-dimensional mesh 33F is formed so as to be substantially equal in length to the touch-and-close fastener 33C (loop side), and is disposed over the touch-and-close fastener 33C (loop side) along the entire length thereof, with the nylon cloth 33G interposed therebetween. Thus, the length of the three-dimensional mesh 33F can be easily adjusted and reduced to the length of a part of the shoulder belts 33L, 33R that comes into contact with the body, which leads to a reduction in the manufacturing cost.

Optionally, a reflective cloth that reflects incident light from a light source in the direction of the light source (e.g., the product with type designation MR-801 manufactured by Unitika Sparklite Ltd.) may be adopted as the tape-like members 33H of the shoulder belts 33L, 33R. In this case, the wearer is not required to wear a reflective vest, which is worn at a construction site etc., over the power assist suit 1, so that the work efficiency can be increased, and an unpleasant feeling, such as hotness, can be mitigated when the wearer wears the power assist suit 1 for long hours. It is preferable that the reflective cloth be shaped to extend in the longitudinal direction and have a predetermined width (e.g., a width of about 20 mm to 70 mm) and a predetermined thickness (e.g., a thickness of about 2 mm or less).

For example, a reflective cloth (e.g., the product with type designation MR-801 manufactured by Unitika Sparklite Ltd.) may be disposed so as to cover edges at both sides in the longitudinal direction of the tape-like member 21A, the front hip belts 22L, 22R, and the upper back hip belts 24L, 24R of the hip harness 20, and sewn together with these edges. Further, a reflective cloth (e.g., the product with type designation MR-801 manufactured by Unitika Sparklite Ltd.) may be disposed so as to cover edges at both sides in the longitudinal direction of a cover 81 and a belt 82 of the thigh harness 80 and sewn together with these edges. This can improve the visibility at a construction site etc. to achieve higher level of safety.

Figure 11:
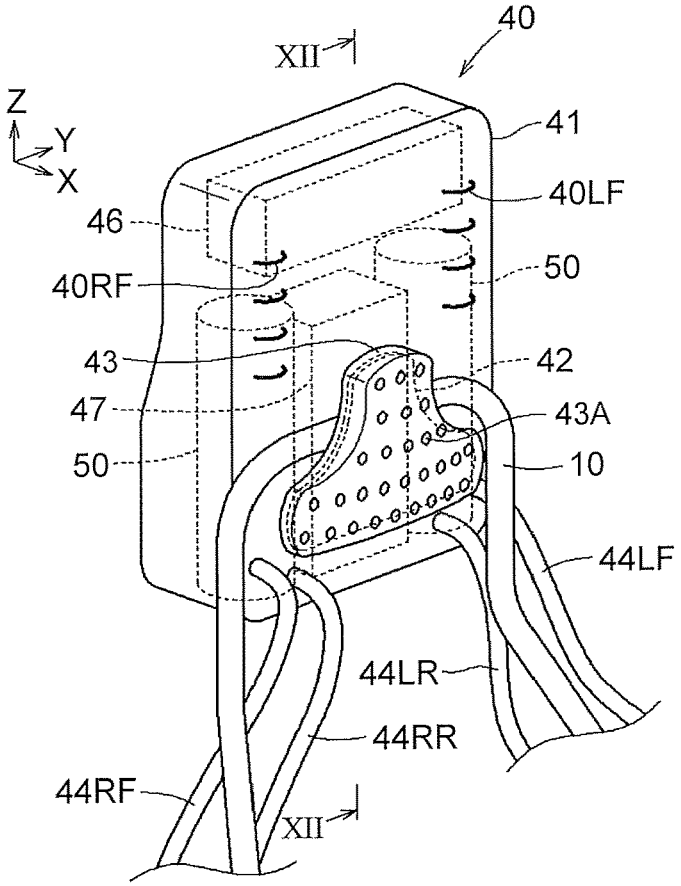
FIG. 11 is a perspective view illustrating an external appearance of a back pad mounted on a power unit.
Figure 12:
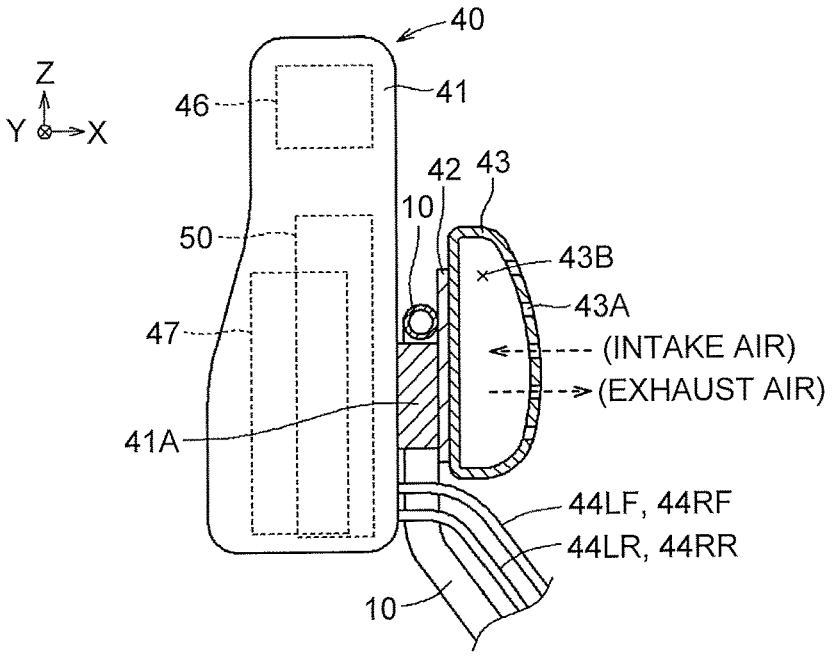
FIG. 12 is a view illustrating the structure of the back pad and a mounted state thereof.

FIG. 11 shows an external appearance of the power unit 40 fixed to the frame 10, and FIG. 12 is a sectional view of a back pad 43, a spacer 41A, and the frame 10 shown in FIG. 11, taken along line XII-XII. As shown in FIG. 1 and FIG. 2, the power unit 40 is fixed to an upper part of the frame 10, on an outer side of the back of the wearer. The spacer 41A is mounted on a part of a power unit case 41 that faces the back of the wearer, and a plate 42 is mounted to the spacer 41A. Further, the back pad 43 is mounted by bonding, with double-faced tape, etc. on the plate 42 that is located closer to the back of the wearer than the upper part of the frame 10 is.

Outer tubes 44RF, 44RR containing cables through which assisting torque is transmitted extend from a lower right portion of the power unit case 41, and outer tubes 44LF, 44LR containing cables through which assisting torque is transmitted extend from a lower left portion of the power unit case 41. The battery 47, power generating parts 50, a controller 46, etc. are housed inside the power unit case 41. The internal structure of the power unit case 41 (the internal structure of the power unit 40) will be described later. As shown in FIG. 1, the power unit case 41 is provided with the couplers 40LF, 40RF (e.g., hooks) to which the couplers 33B of the respective shoulder belts 33L, 33R of the chest harness 30 are coupled.

The back pad 43 is formed by an elastic body, such as rubber (e.g., the closed-cell polyethylene foam with type designation L-2500 manufactured by Sanwa Kako Co., Ltd.). As shown in FIG. 11 and FIG. 12, the back pad 43 has an inverted T-shape as seen from the front side, with a predetermined thickness (e.g., a thickness of about 10 mm to 100 mm, preferably about 35 mm) in a front-rear direction (a right-left direction in FIG. 12). The back pad 43 is disposed such that a central portion thereof in the right-left direction faces the backbone of the wearer. As shown in the sectional view of FIG. 12, the back pad 43 is hollow with a cavity 43B formed inside, and a plurality of vent holes 43A that allows communication between an inside and an outside of the back pad 43 is provided in a surface of the back pad 43 on the side facing the back of the wearer.

Figure 13:
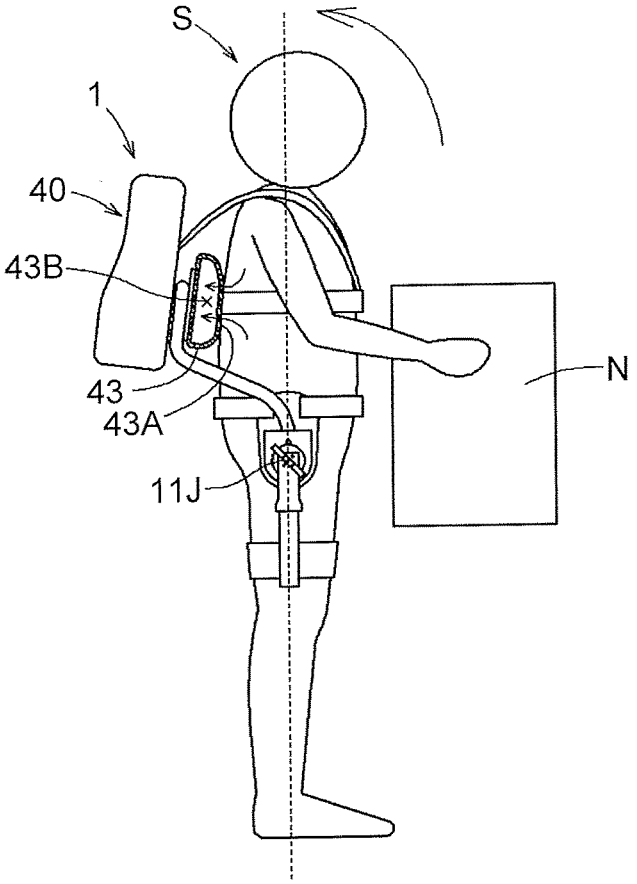
FIG. 13 is a view illustrating an example of a state where the back pad restores its original form and takes in air when the posture of the wearer changes from a stooping state to an upright standing state during load lifting work.

For example, as shown in FIG. 13, when the wearer S straightens up his or her back to assume an upright standing state during work of lifting a load N, the force with which the back of the wearer squeezes the back pad 43 decreases, so that the back pad 43 having been compressed restores its original form and takes air into the cavity 43B through the vent holes 43A. An airflow created in the process allows the wearer S to feel coolness.

Figure 14:
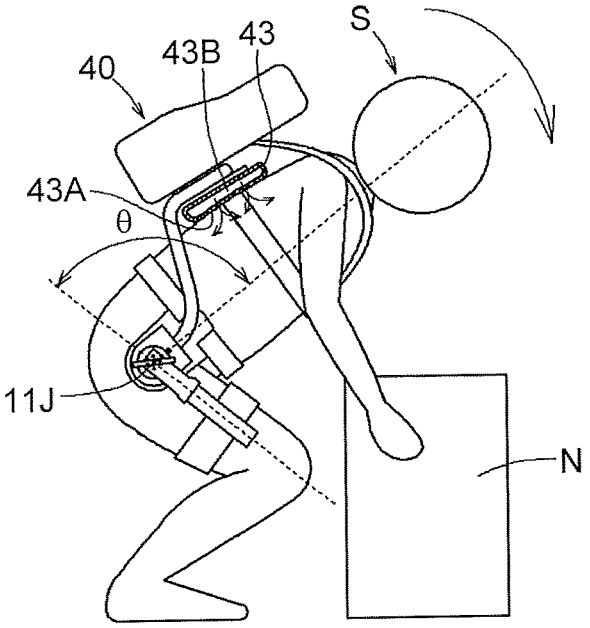
FIG. 14 is a view illustrating an example of a state where the back pad is compressed and exhausts air when the posture of the wearer changes from an upright standing state to a stooping state during load lifting work.

On the other hand, as shown in FIG. 14, when the wearer S assumes a stooping state trying to lift the load N, the force with which the back of the wearer S squeezes the back pad 43 increases, so that the back pad 43 is compressed and squeezed, and discharges and exhausts air from the cavity 43B through the vent holes 43A. An airflow created in the process allows the wearer S to feel coolness. Thus, it is possible to promote comfort during work by creating an airflow at the back of the wearer S each time the wearer S performs work that involves repeatedly assuming a stooping posture and an upright standing posture.

Since the power unit case 41 or the frame 10 is pressed against the back of the wearer S through the back pad 43 that is an elastic body when the wearer S is in a stooping posture, the wearer S can be prevented from feeling pain in the back and the work efficiency can be increased. Having substantially an inverted T-shape, the back pad 43 can prevent twisting of the power unit case 41 and the frame 10 in the right-left direction, ensuring effective transmission of assisting force.

Figure 15:
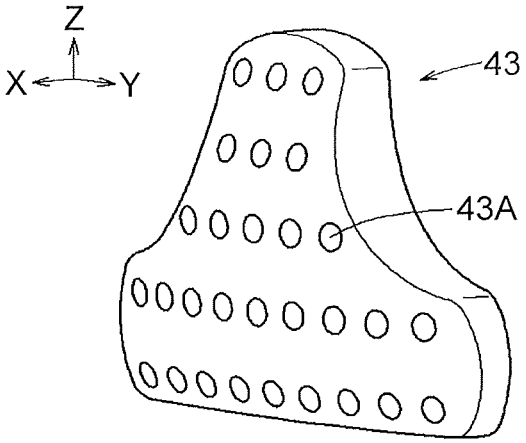
FIG. 15 is a view illustrating an example in which a surface of the back pad that comes into contact with the back of the wearer has a convex shape toward the back of the wearer.
Figure 16:
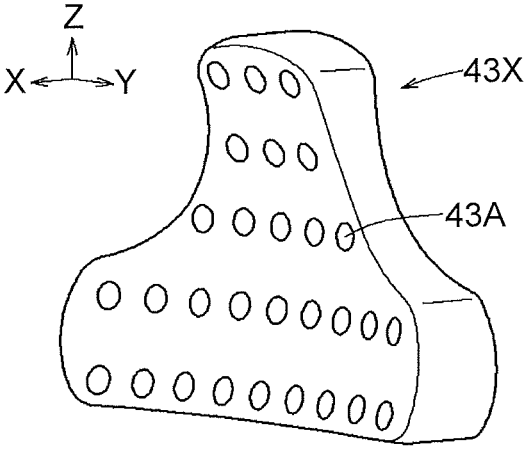
FIG. 16 is a view illustrating an example in which the surface of the back pad that comes into contact with the back of the wearer has a concave shape toward the back of the wearer.
Figure 17:
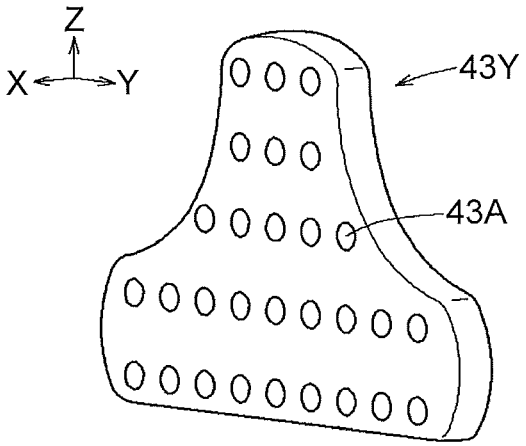
FIG. 17 is a view illustrating an example in which the surface of the back pad that comes into contact with the back of the wearer has a flat shape toward the back of the wearer.

The back pad 43 may be the back pad 43 as shown in FIG. 15 of which a surface facing the back of the wearer has a smooth convex shape; or a back pad 43X as shown in FIG. 16 of which a surface facing the back of the wearer has a smooth concave shape; or a back pad 43Y as shown in FIG. 17 of which a surface facing the back of the wearer has a flat shape. The shape of the back pad 43 is not particularly limited. It is preferable that the vent holes 43A be provided in only the surface facing the back of the wearer.

In another example, a small air blower may be disposed inside the cavity 43B of the back pad 43, and this air blower may be driven only when necessary, to send air to the back of the wearer through the vent holes 43A to thereby produce a cooling effect.

In yet another example, the cavity 43B of the back pad 43 may be omitted and the back pad 43 may have a solid structure provided with a plurality of through-holes extending through the back pad 43 in the front-rear direction (the right-left direction in FIG. 12). Thus, good ventilation is secured also when the back pad 43 has a solid structure, so that an unpleasant feeling, such as hotness, can be mitigated when the wearer wearing the power assist suit closely fitted on his or her body performs work that involves repeatedly assuming a stooping posture and an upright standing posture for long hours.

Figure 18:
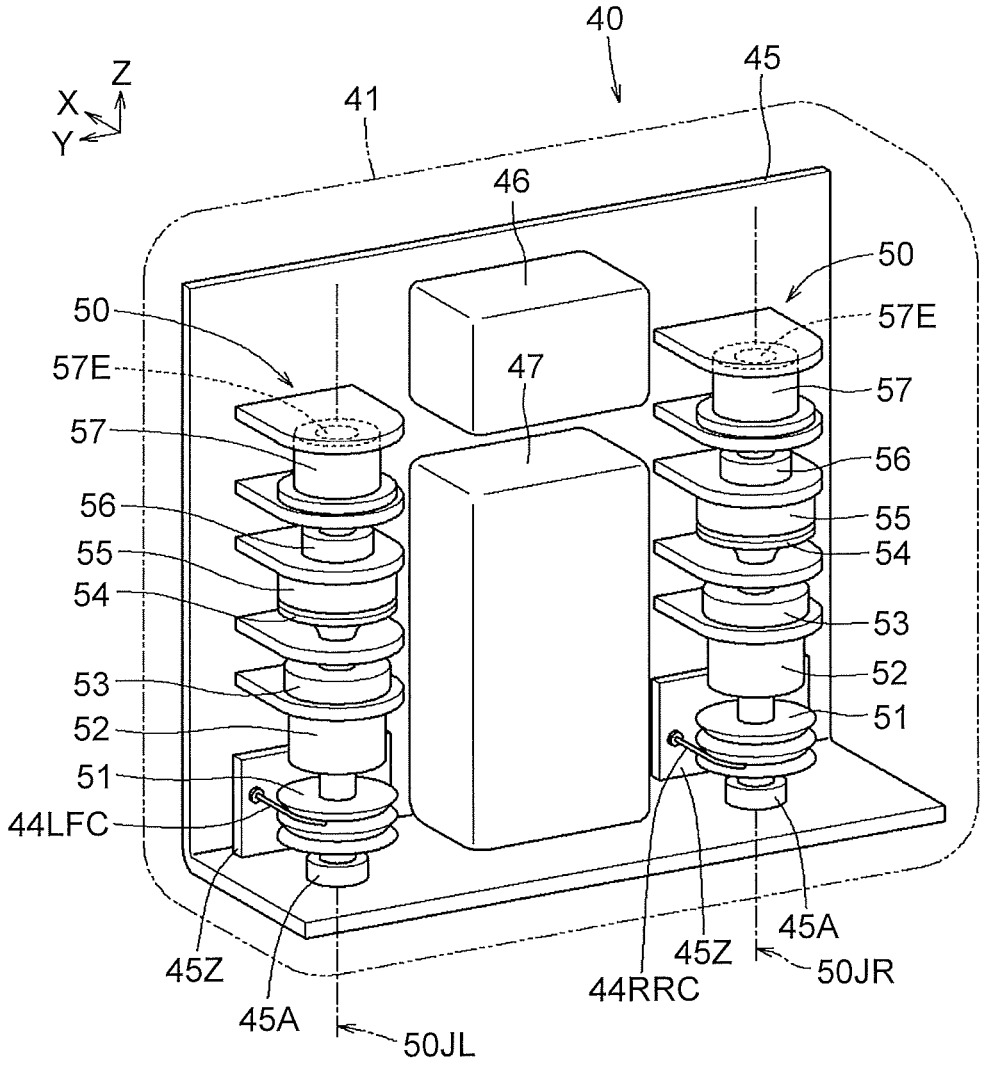
FIG. 18 is a perspective view illustrating an example of the arrangement of power generating parts, a battery, and a controller inside the power unit.

The power unit 40 has the power generating parts 50 that generate assisting torque to be transmitted respectively to the assist unit 60L and assist unit 60R. As shown in FIG. 18, a reinforcing frame 45, the controller 46, the battery 47, the power generating parts 50, etc. are housed inside the power unit case 41 made of resin etc. The reinforcing frame 45 is made of metal, such as aluminum, and serves to support and position parts composing the power generating parts 50 and serves as a radiator plate for the controller 46 and the battery 47.

Figure 19:
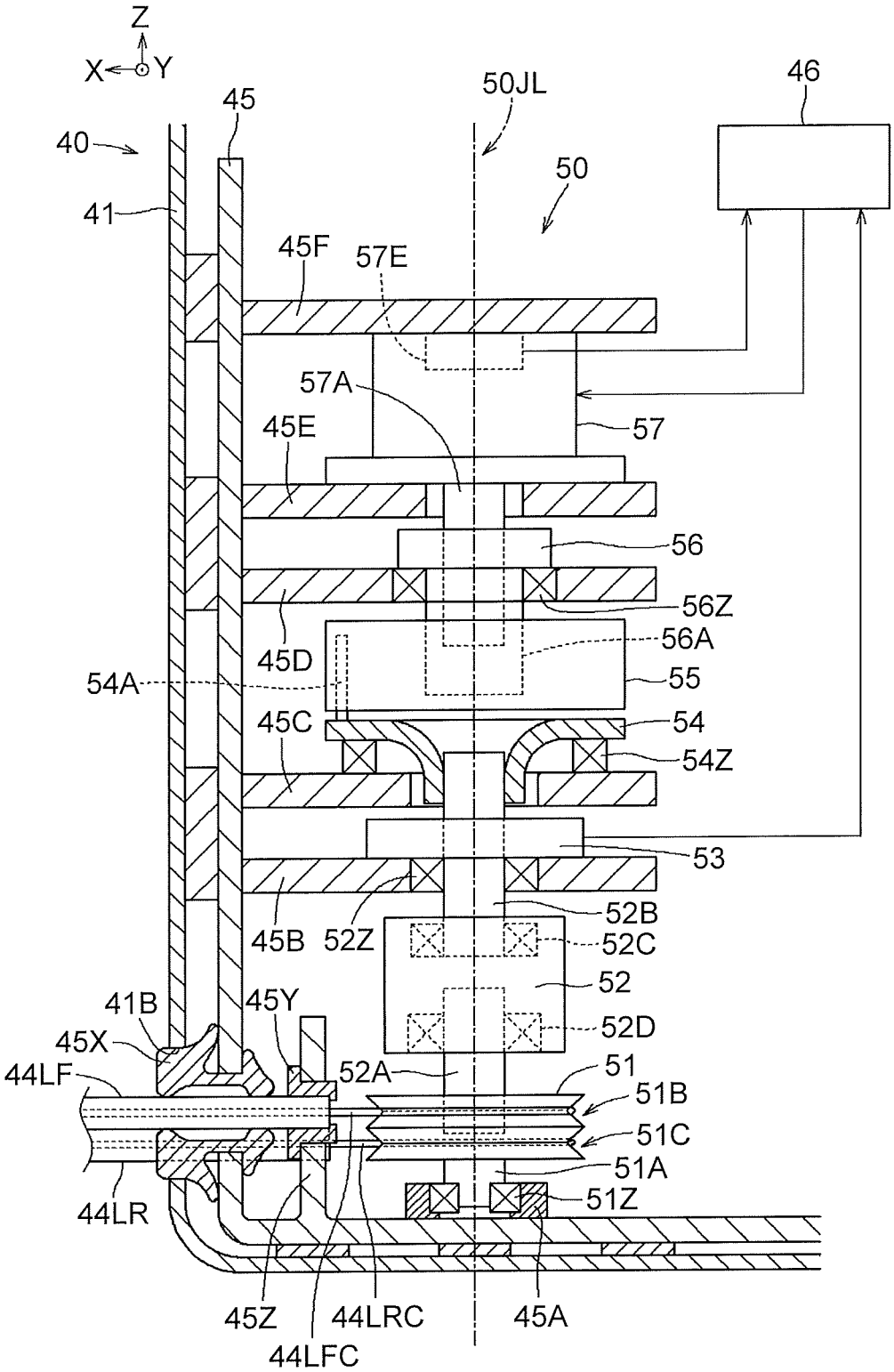
FIG. 19 is a view illustrating the structure of the power generating part and a supported state thereof.

The power generating parts 50 are a right and left pair, and each have a drive pulley 51, a speed reducer 52, an encoder 53 (rotation angle detection means), an outer urging body 54, a spiral spring 55, an inner urging body 56, an electric motor 57, etc. The electric motor 57 has an encoder 57E (rotation angle detection means). As shown in FIG. 19, the drive pulley 51, the speed reducer 52, the encoder 53, the outer urging body 54, the spiral spring 55, the inner urging body 56, and the electric motor 57 are disposed so as to turn around power turning axis 50JL or 50JR. In the following, the power generating part 50 on the left side will be described in detail using FIG. 19. The electric motor 57 corresponds to an actuator that generates assisting torque.

As shown in FIG. 19, a bearing supporting body 45A is provided at a lower end of the reinforcing frame 45, and an outer ring of a bearing 51Z (radial bearing) is fixed to the bearing supporting body 45A.

A pulley shaft 51A of the drive pulley 51 is fitted on an inner ring of the bearing 51Z. A speed reducing shaft 52A of the speed reducer 52 is fitted on the drive pulley 51. The drive pulley 51 is formed by a two-groove pulley, and has pulley grooves 51B, 51C. The cable 44LFC inside the outer tube 44LF is wound around the pulley groove 51B, and the cable 44LRC inside the outer tube 44LR is wound around the pulley groove MC. For example, the outer tubes 44LF, 44LR are resin tubes, and the cables 44LFC, 44LRC are wires each formed by a bundle of thin wires made of stainless steel etc. The drive pulley 51 is made of resin, such as polyacetal.

The outer tube 44LF and the cable 44LFC are guided by a guide member 45Y mounted on a supporting body 45Z that is provided on the reinforcing frame 45, and are inserted through a grommet 45X mounted in a cable hole 41B and drawn to an outside of the reinforcing frame 45 and the power unit case 41. The grommet 45X is made of an elastic body, such as rubber, and seals holes in the reinforcing frame 45 and the power unit case 41 as well as seals the gap around the outer tube 44LF to prevent entry of rainwater etc. from the outside of the power unit case 41 into the power unit case 41. The supporting body 45Z and the guide member 45Y correspond to a cable guide, and guide the cable 44LFC wound around the drive pulley 51 to the cable hole 41B in a straight line. Thus, the cable 44LFC is not subjected to a force in a straining direction, so that a decrease in the assisting torque transmission efficiency, breakage of the cable 44LFC, etc. can be prevented. To protect the outer tubes 44LF, 44LR, 44RF, 44RR and the frame 10 or to protect the wearer, a cover may be provided that covers a part or the whole of the frame 10 along with the outer tubes 44LF, 44LR, 44RF, 44RR.

A speed increasing shaft 52B of the speed reducer 52 is fitted on a bearing 52Z (radial bearing) fitted in a hole of a supporting body 45B that is provided on the reinforcing frame 45, and is also fitted on a bearing 52C inside the speed reducer 52. An outer ring of the bearing 52Z is fitted on the supporting body 45B, and the speed increasing shaft 52B is fitted on an inner ring of the bearing 52Z. The speed reducer 52 reduces the speed of rotation input into the speed increasing shaft 52B according to a set speed reduction ratio and outputs the resulting rotation to the speed reducing shaft 52A. Conversely, the speed reducer 52 increases the speed of rotation input into the speed reducing shaft 52A according to an inverse of the set speed reduction ratio (1/speed reduction ratio) and outputs the resulting rotation to the speed increasing shaft 52B. The speed reducing shaft 52A is supported by being fitted on a bearing 52D inside the speed reducer 52.

Thus, the drive pulley 51 is supported by the bearing 51Z and the bearing 52D of the speed reducing shaft 52A so as to be supported with both ends fixed. As shown in FIG. 19, a drive pulley shaft member forming the shaft of the drive pulley 51 is composed of the pulley shaft 51A and the speed reducing shaft 52A. As shown in FIG. 19, the drive pulley shaft member (the pulley shaft 51A and the speed reducing shaft 52A) is supported inside the power unit 40 by the bearing 51Z and the bearing 52D, at both sides of the drive pulley 51 in the direction of a drive pulley rotational axis (in this case, the power turning axis 50JL). Thus, compared with when only the speed reducing shaft 52A is supported in the form of a cantilever, the drive pulley shaft member is supported more rigidly by the bearing 51Z and the bearing 52D. Therefore, compared with when the speed reducing shaft 52A is supported in the form of a cantilever, the drive pulley 51 can be supported by smaller bearing 52C and bearing 52D, and a smaller speed reducer can be employed. Alternatively, the speed reducing shaft 52A may be further supported by a supporting body (not shown) provided on the reinforcing frame 45 and a bearing (not shown) provided on this supporting body.

Since assisting torque is transmitted through the cables, the drive pulley 51 and the idler pulleys 63L, 63R can be disposed such that the drive pulley rotational axis (in this case, the power turning axis 50JL) shown in FIG. 19 and the imaginary turning axis 11J (i.e., an idler pulley rotational axis) shown in FIG. 1 and FIG. 2 are not parallel to each other. Thus, great flexibility is allowed in disposing the pulleys and the drive pulley 51 can be flexibly disposed, which is convenient in that various arrangements can be tried out to achieve improvement of the power transmission efficiency or a reduction in size and weight.

The encoder 53 is mounted on the supporting body 45B provided on the reinforcing frame 45, is fitted on the speed increasing shaft 52B, and outputs a detection signal according to rotation of the speed increasing shaft 52B to the controller 46. Based on the detection signal from the encoder 53, the controller 46 can detect a forward leaning angle θ (see FIG. 14) of the upper body relative to the thighs of the wearer.

Figure 20:
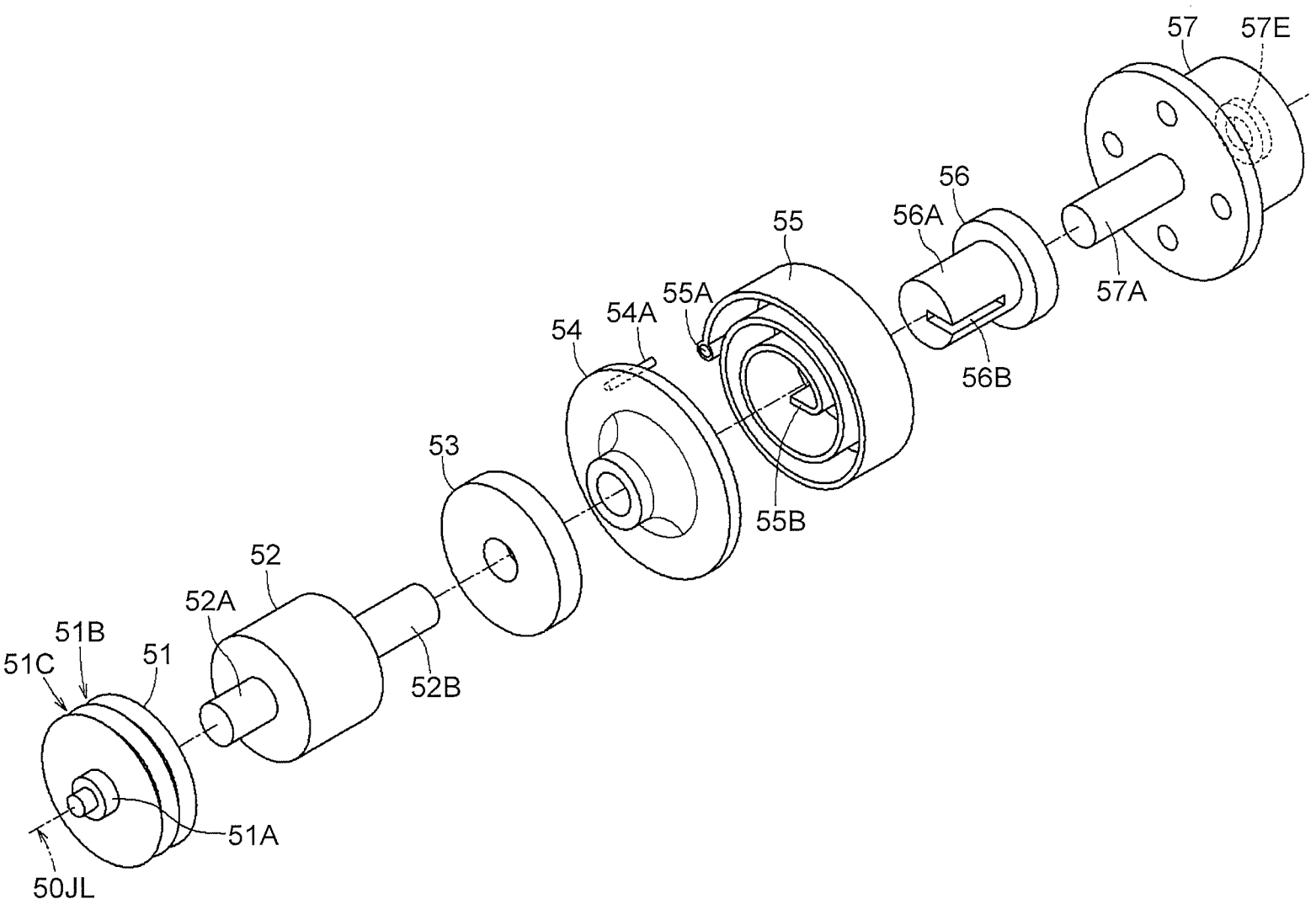
FIG. 20 is a perspective view illustrating an example of an external appearance of parts composing the power generating part.

The outer urging body 54 is fitted at a leading end of the speed increasing shaft 52B, and is supported through a bearing 54Z (thrust bearing) by a supporting body 45C provided on the reinforcing frame 45. The outer urging body 54 has a flange shape, and has a spring supporting shaft 54A near an edge thereof. As shown in FIG. 20, the spring supporting shaft 54A is inserted into a supporting hole 55A that is provided at an outer peripheral end of the spiral spring 55. Thus, the outer urging body 54 causes the spiral spring 55 to rotate in a compression direction or an expansion direction as the speed increasing shaft 52B rotates.

As shown in FIG. 20, the spring supporting shaft 54A of the outer urging body 54 is inserted into the supporting hole 55A formed at an outer peripheral end of the spiral spring 55, and an inner peripheral end 55B of the spiral spring 55 is inserted into a groove 56B formed in a shaft 56A of the inner urging body 56. Thus, the outer peripheral end of the spiral spring 55 is supported by the spring supporting shaft 54A of the outer urging body, and the inner peripheral end 55B of the spiral spring 55 is supported by the shaft 56A of the inner urging body 56. The side of the inner peripheral end 55B of the spiral spring 55 is rotated in the compression direction or the expansion direction through the inner urging body 56 as a result of rotation of the electric motor 57. The side of the outer peripheral end of the spiral spring 55 is rotated in the compression direction or the expansion direction through the speed reducer 52 and the outer urging body 54 as a result of rotation of the drive pulley 51 according to the forward leaning angle of the upper body relative to the thighs of the wearer.

The inner urging body 56 has the inner peripheral end 55B of the spiral spring 55 inserted in the groove 56B, is fitted on a motor shaft 57A of the electric motor 57, and is supported through a bearing 56Z (radial bearing) by a supporting body 45D provided on the reinforcing frame 45.

The electric motor 57 is supported by supporting bodies 45E, 45F provided on the reinforcing frame 45. The motor shaft 57A of the electric motor 57 is fitted on the inner urging body 56. The electric motor 57 has the encoder 57E that outputs a detection signal according to rotation of the motor shaft 57A. The electric motor 57 is driven to rotate through a control signal from the controller 46, and outputs a detection signal according to the rotation from the encoder 57E to the controller 46.

The controller 46 includes: communication means for wirelessly sending and receiving information to and from the remote controller 90 (see FIG. 1 and FIG. 2); control means (CPU) for calculating assisting torque based on a command input from the remote controller 90 and detection signals from the encoder 53 and the encoder 57E; and a driver circuit that converts a driving signal from the control means into a current supplied to the electric motor 57.

For example, the battery 47 is a lithium-ion capacitor or a lithium-ion battery, and supplies electricity to the controller 46 and the electric motor 57.

As shown in FIG. 3 and FIG. 4, the assist unit 60L is worn on (connected to) the thigh of the wearer S and the set of harness (the frame 10 and the hip harness 20), to assist a motion of the thigh relative to the hip of the wearer S (or a motion of the hip relative to the thigh of the wearer S). Similarly, the assist unit 60R is worn on (connected to) the thigh of the wearer S and the set of harness (the frame 10 and the hip harness 20), to assist a motion of the thigh relative to the hip of the wearer S (or a motion of the hip relative to the thigh of the wearer S).

As shown in FIG. 1, the assist unit 60L has a turning part 61L that is a part around the idler pulley 63L, and a link 70L that is a part downward from the swinging arm 71L. Similarly, the assist unit 60R has a turning part 61R that is a part around the idler pulley 63R, and a link 70R that is a part downward from the swinging arm 71R. Since the structure of the turning part 61L of the assist unit 60L and the structure of the turning part 61R of the assist unit 60R are the same, the turning part 61L of the assist unit 60L will be described below as an example. In the link 70R shown in FIG. 27, an arm connecting the idler pulley 63L and a thigh-worn part 78L to each other is formed by the swinging arm 71R, an intermediate arm 72, and a rail 73 (see FIG. 1), and the link 70L has the same configuration. Thus, the swinging arm 71L corresponds to a part of the arm.

As shown in FIG. 23, the turning part 61L around the idler pulley 63L in the assist unit 60L is composed of, from the left side, a rotation stopper 62L, the shaft 68, the swinging arm 71L, the idler pulley 63L, an adapter 64A, a pulley case 65, the turning supporting portion 11L of the frame 10, the adapter 64B, the coupling member 66, the adapter 64C, the slip-out preventing ring 67, etc. The idler pulley 63L and the pulley case 65 are made of resin etc.

Figure 22:
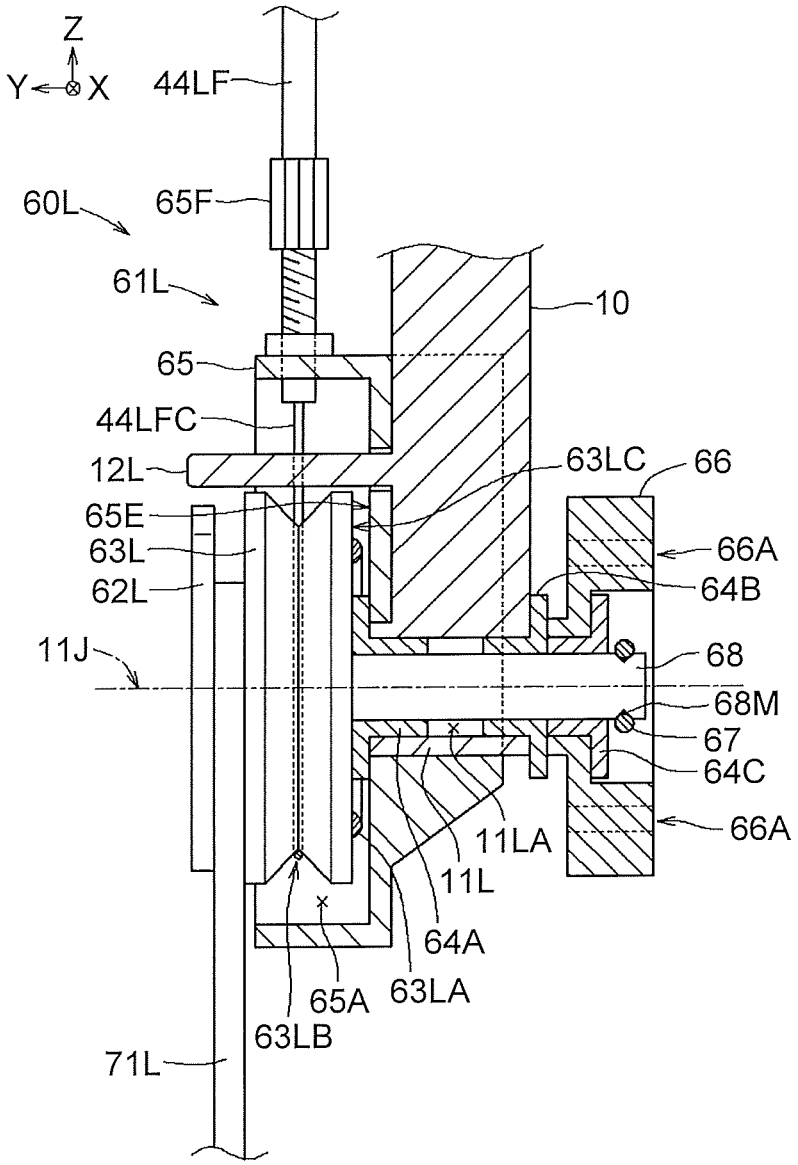
FIG. 22 is a sectional view of the turning part shown in FIG. 21, taken along line XXII-XXII.
Figure 24:
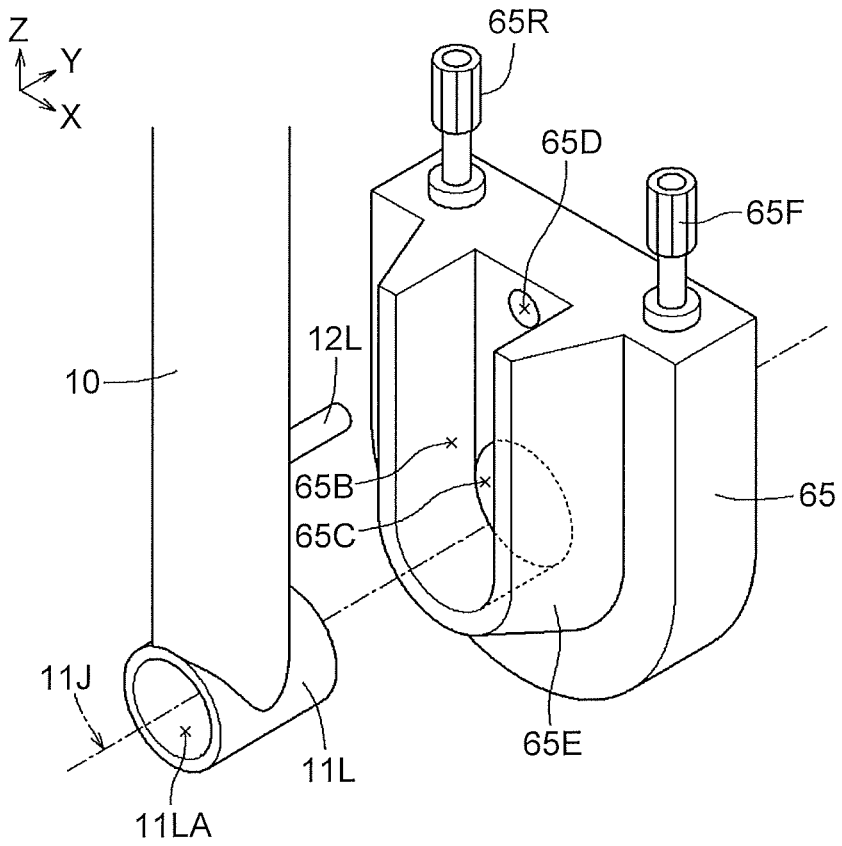
FIG. 24 is a perspective view illustrating an example of the shape of a portion in the turning part shown in FIG. 21 at which the frame and a pulley case are connected to each other.

FIG. 22 shows a state where the parts shown in FIG. 23 have been assembled. As shown in FIG. 24, a lower end portion of the frame 10 is fitted into a frame housing space 65B of the pulley case 65, and the turning supporting portion 11L of the frame 10 is fitted into a supporting hole 65C of the pulley case 65, and then the stopper 12L of the frame 10 is inserted into a stopper hole 65D of the pulley case 65. As shown in FIG. 22 and FIG. 23, the adapter 64A is fitted from the side of the pulley housing space 65A (see FIG. 23) of the pulley case 65, and the idler pulley 63L and the swinging arm 71L are disposed so as to cover the adapter 64A, and then the shaft 68 is inserted. After the shaft 68 is inserted, the rotation stopper 62L is disposed, and the rotation stopper 62L, the swinging arm 71L, and the idler pulley 63L are fixed to one another with fastening members, such as screws, so as to be integrated. Thereafter, the adapter 64B, the coupling member 66, and the adapter 64C are fitted from the side of a leading end of the shaft 68 that is the side opposite from the pulley housing space 65A of the pulley case 65 (see FIG. 23), and the slip-out preventing ring 67 (e.g., a C-ring) is fitted into a groove 68M at the leading end of the shaft 68. This structure allows the idler pulley 63L, the swinging arm 71L, and the rotation stopper 62L to turn integrally around the imaginary turning axis 11J. The coupling member 66 can also turn around the imaginary turning axis 11J.

Figure 21:
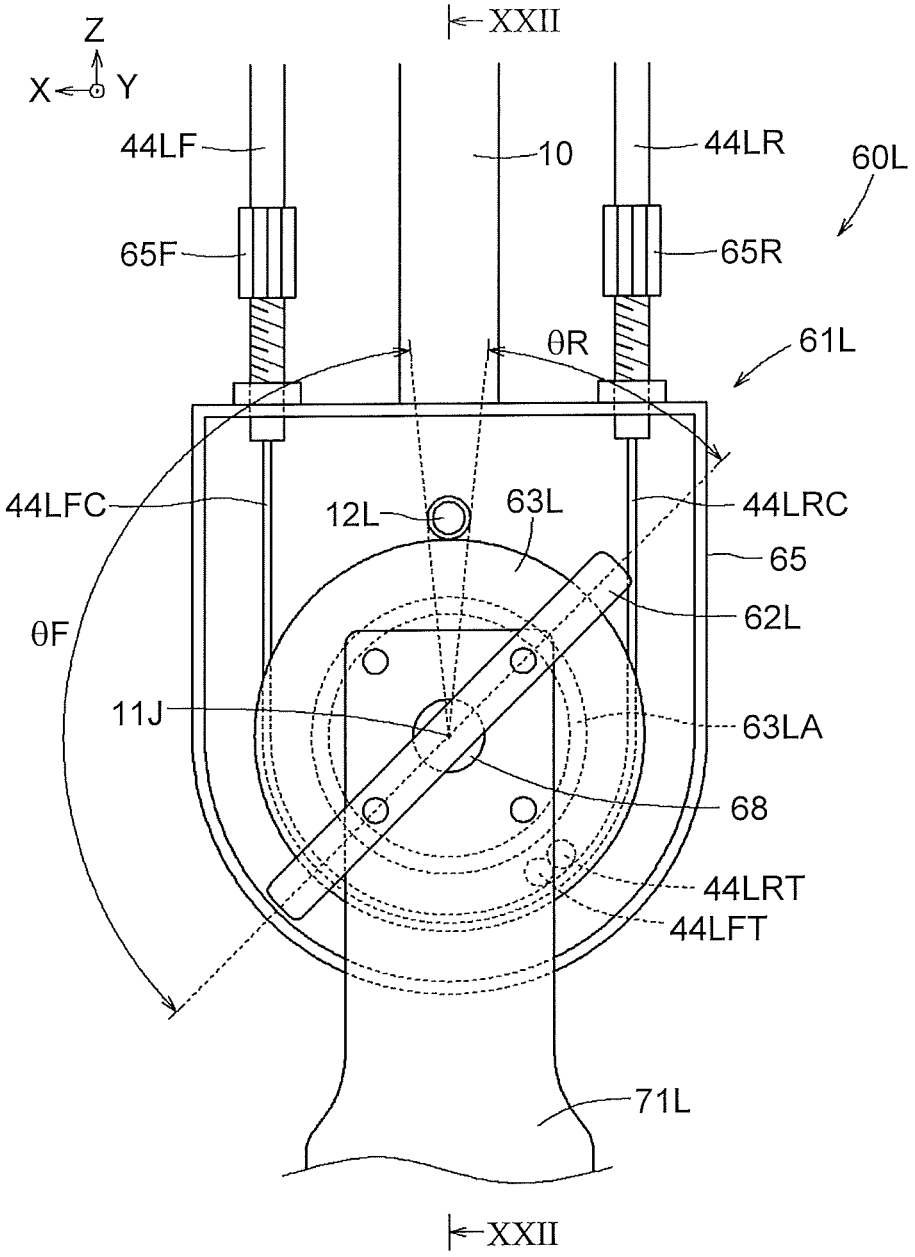
FIG. 21 is a view illustrating the structure of a turning part around an idler pulley in an assist unit.

In FIG. 21, an adjusting member 65R is provided on an upper right side of the pulley case 65, and an adjusting member 65F is provided on an upper left side of the pulley case 65. The adjusting members 65F, 65R are similar to members by which the length of a brake cable of a bicycle is adjusted, for example, and allow adjustment of the lengths of protrusion of the cables 44LFC, 44LRC from the outer tubes 44LF, 44LR. The cable 44LFC extending from the adjusting member 65F is wound around a groove 63LB (see FIG. 22) of the idler pulley 63L, and a barrel end 44LFT at a leading end of the cable 44LFC is housed inside a barrel end housing part formed in the idler pulley 63L. Similarly, the cable 44LRC extending from the adjusting member 65R is wound around the groove 63LB (see FIG. 22) of the idler pulley 63L, and a barrel end 44LRT at a leading end of the cable 44LRC is housed inside a barrel end housing part formed in the idler pulley 63L.

In FIG. 21, when the drive pulley 51 (see FIG. 19) is driven to rotate and the cable 44LFC is pulled upward while the cable 44LRC is extended downward, the idler pulley 63L rotates in a clockwise direction (rightward rotation direction) around the imaginary turning axis 11J. When the drive pulley 51 (see FIG. 19) is driven to rotate and the cable 44LFC is extended downward while the cable 44LRC is pulled upward, the idler pulley 63L rotates in a counterclockwise direction (leftward rotation direction) around the imaginary turning axis 11J.

When the idler pulley 63L rotates in the rightward rotation direction from the state shown in FIG. 21 (in this case, when the wearer increases the forward leaning angle), the rotation stopper 62L hits the stopper 12L at a rotation angle θF, so that the idler pulley 63L cannot rotate further in the rightward rotation direction. This means that the forward leaning angle θ (see FIG. 14) of the wearer from the upright standing state is restricted to the rotation angle θF. or smaller. Similarly, when the idler pulley 63L rotates in the leftward rotation direction from the state shown in FIG. 21 (in this case, when the wearer increases the backward leaning angle), the rotation stopper 62L hits the stopper 12L at a rotation angle θR, so that the idler pulley 63L cannot rotate further in the leftward rotation direction. This means that the backward leaning angle of the wearer from the upright standing state is restricted to the rotation angle θR or smaller.

Thus, the rotation stopper 62L and the stopper 12L constitute a stopper mechanism that restricts the range of the rotation angle of the idler pulley 63L (i.e., the range of the swinging angle of the swinging arm 71L) that is the range of swinging of the thighs relative to the hips of the wearer. This stopper mechanism with a simple structure can prevent the wearer from assuming a state of leaning forward or bending backward exceeding his or her physical limit, and can appropriately avoid placing a physical burden on the wearer.

Figure 25:
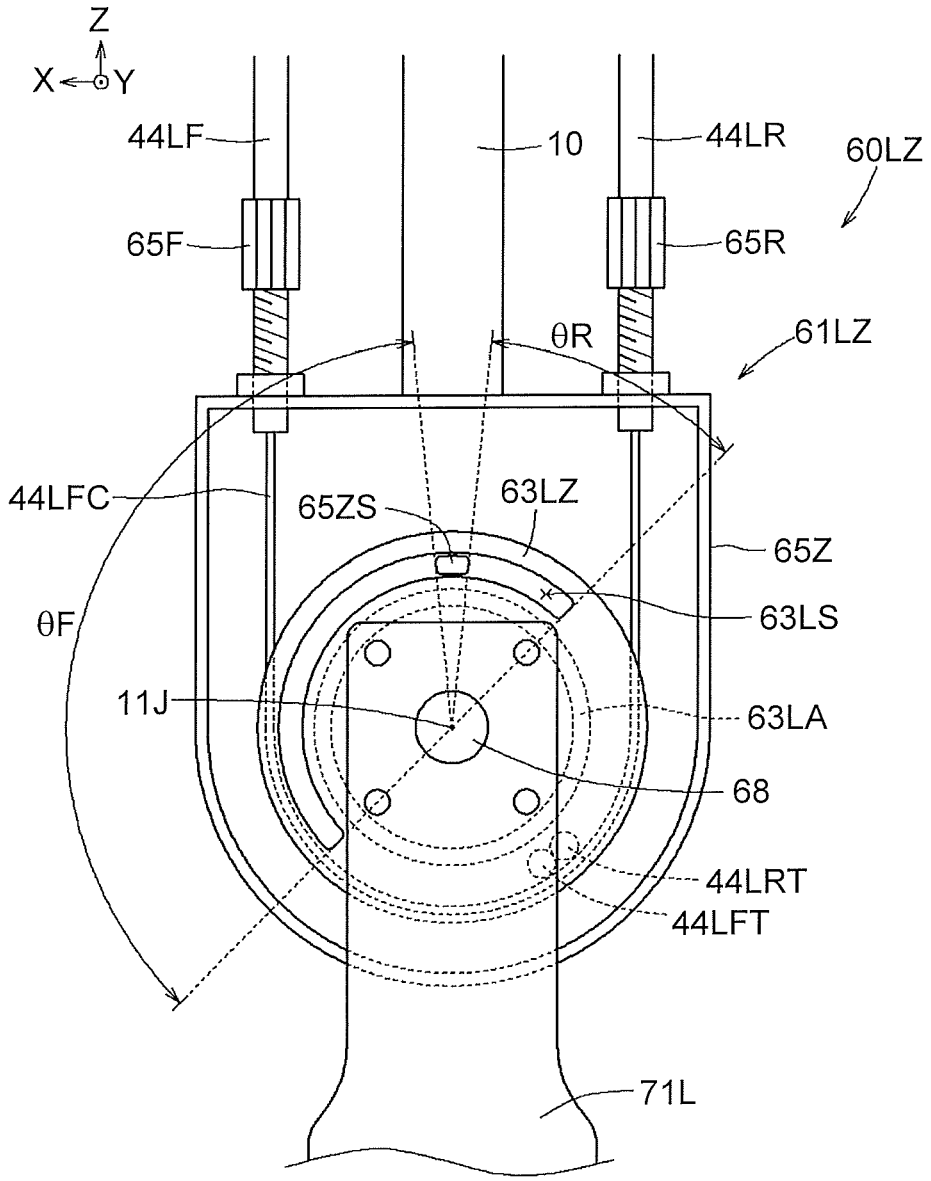
FIG. 25 is a view illustrating another example of a stopper mechanism that restricts the range of the rotation angle of the idler pulley (the range of the swinging angle of a swinging arm) relative to the turning part shown in FIG. 21.

Instead of the stopper mechanism formed by the rotation stopper 62L and the stopper 12L shown in FIG. 21, a stopper mechanism formed by a slit 63LS and a stopper 65ZS as shown in FIG. 25 may be employed. In a turning part 61LZ of an assist unit 60LZ shown in FIG. 25, the slit 63LS is formed along an outer periphery of an idler pulley 63LZ. A pulley case 65Z is provided with the stopper 65ZS that is formed to protrude so as to be inserted into the slit 63LS. Also in this case, as in FIG. 21, the forward leaning angle of the wearer from the upright standing state is restricted to the rotation angle θF. or smaller, and the backward leaning angle of the wearer from the upright standing state is restricted to the rotation angle θR or smaller.

Optionally, an elastic member may be provided between the rotation stopper 62L and the stopper 12L (or between an end of the slit 63LS and the stopper 65Z S) to reduce the impact of hitting. The controller 46 may be configured to control the electric motor so as to reduce the swinging speed and thereby reduce the impact immediately before the rotation stopper 62L hits the stopper 12L. (The controller 46 knows the angle at which the rotation stopper 62L hits the stopper 12L).

As shown in FIG. 22, a surface of the idler pulley 63L that is orthogonal to the idler pulley rotational axis being the rotational axis of the idler pulley 63L (in this case, the imaginary turning axis 11J) and that faces the pulley case 65 will be referred to as an idler pulley end surface 63LC. A surface of the pulley case 65 that faces the idler pulley end surface 63LC from a close distance without coming into contact therewith will be referred to as an opposite case surface 65E. At least one of the idler pulley end surface 63LC and the opposite case surface 65E has a contact area reducing structure that reduces the area of contact between the idler pulley end surface 63LC and the opposite case surface 65E in the case where the two come into contact with each other as the idler pulley 63L tilts relative to the idler pulley rotational axis (in this case, the imaginary turning axis 11J). In the example of FIG. 22, the contact area reducing structure is formed by a protrusion 63LA that protrudes from the idler pulley end surface 63LC toward the opposite case surface 65E. The protrusion 63LA is formed in a ring shape continuous around the idler pulley rotational axis (imaginary turning axis 11J), and has a semi-circular shape in cross section when cut along an imaginary plane including the idler pulley rotational axis (imaginary turning axis 11J).

Therefore, when the protrusion 63LA comes into contact with the opposite case surface 65E, the contact is linear contact, which has a smaller area of contact than surface contact. Specifically, even when the idler pulley 63L tilts in a case such as when an unexpected large force is applied from the swinging arm 71L to the idler pulley 63L, or when an unexpected large force is applied from the cables 44LFC, 44LRC to the idler pulley 63L, the area of contact between the idler pulley 63L and the pulley case 65 is small. Thus, friction can be further reduced, and loss of assisting torque due to friction can be further reduced. The protrusion 63LA needs to be formed in at least one of the idler pulley end surface 63LC and the opposite case surface 65E. The shape of the protrusion 63LA is not limited to a continuous ring shape, and a plurality of protrusions having a hemispherical shape (a semi-circular shape in cross section) may be formed on at least one of the idler pulley end surface 63LC and the opposite case surface 65E. The shape (cross-sectional shape) of these protrusions is not limited to a semi-circular shape.

As shown in FIG. 1, the assist unit 60L has the turning part 61L and the link 70L, and the assist unit 60R has the turning part 61R and the link 70R. Since the structure of the link 70L and the structure of the link 70R are the same, the link 70R will be described below as an example.

As shown in FIG. 1, the link 70R of the assist unit 60R has the arm (the swinging arm 71R, the intermediate arm 72, and the rail 73) that swings by assisting torque transmitted from the power unit 40, and a thigh-worn part 78R that is worn on the thigh of the wearer and moves along the arm. Thus, the swinging arm 71R, the intermediate arm 72, and the rail 73 each constitute a part of the arm, and the arm connects the idler pulley 63R and the thigh-worn part 78R to each other. The arm has an elongated shape extending from a side part of the hip of the wearer along a side part of the thigh of the wearer. FIG. 27 shows an external appearance of the link 70R, and FIG. 26 shows parts composing the link 70R.

As shown in FIG. 27, the link 70R has the swinging arm 71R, the intermediate arm 72, the rail 73, a cap 74, a sliding movable part 75, the thigh-worn part 78R, etc.

Figure 26:
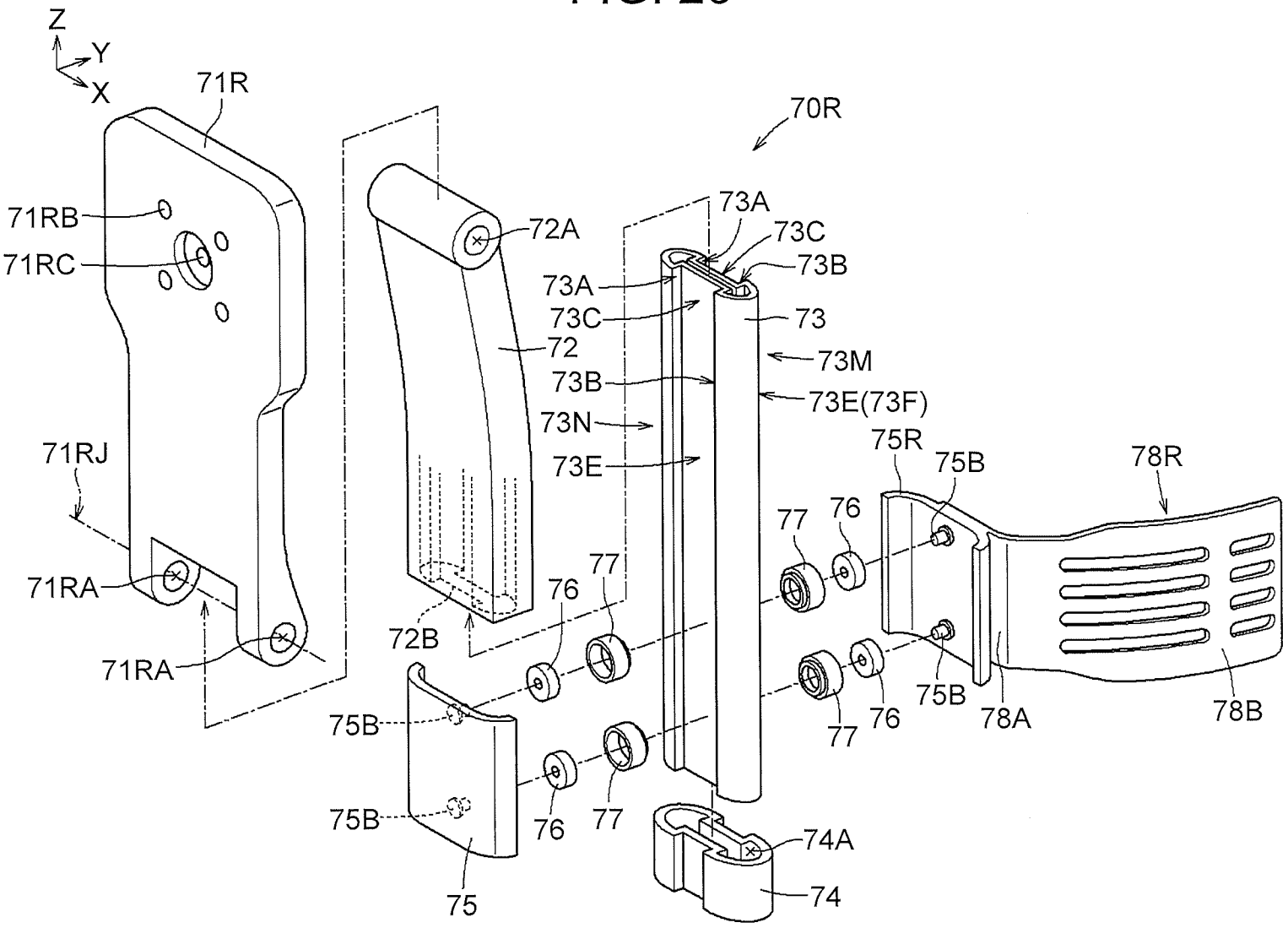
FIG. 26 is an exploded perspective view illustrating the structure of a link from the swinging arm to a thigh-worn part in the assist unit.
Figure 27:
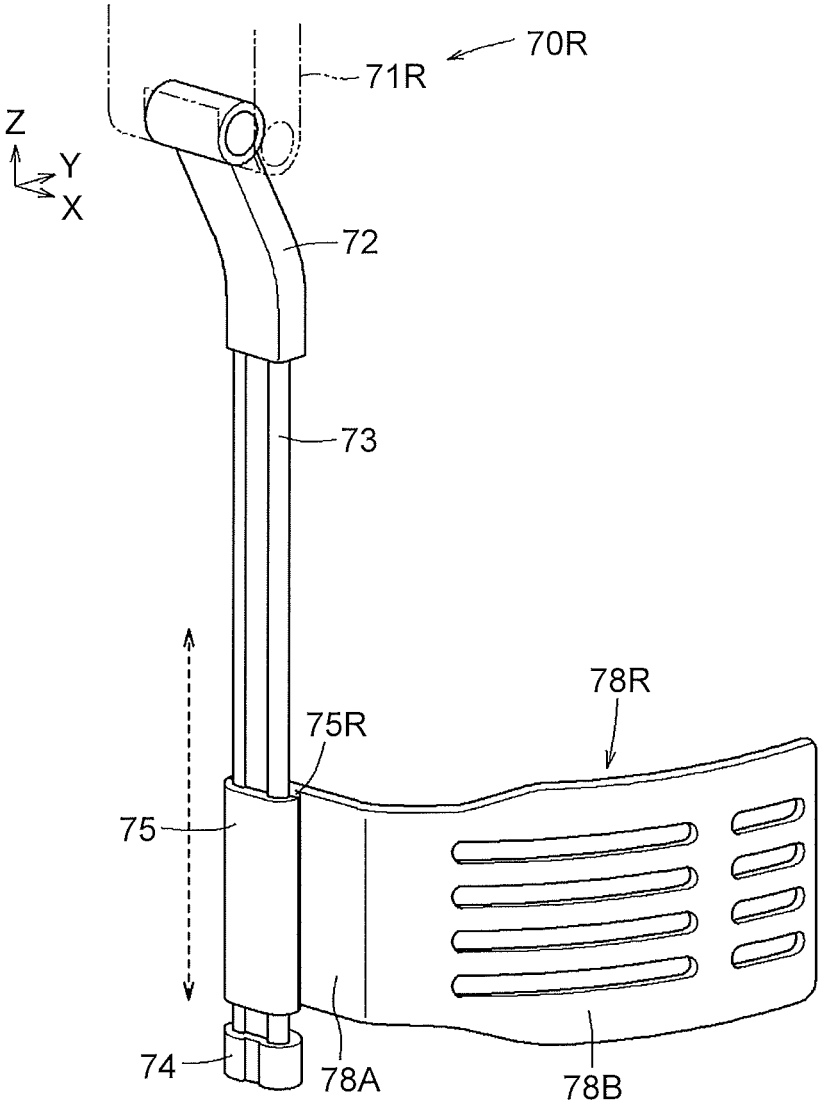
FIG. 27 is a perspective view illustrating an external appearance of the link into which the parts shown in FIG. 26 have been assembled.

As shown in FIG. 26, the swinging arm 71R is an elongated plate-shaped member extending along the longitudinal direction of the thigh of the wearer. At an upper part of the swinging arm 71R, fastening holes 71RB used to mount the idler pulley 63R, and a shaft hole 71RC into which the shaft 68 is inserted are formed (see the swinging arm 71L in FIG. 21 to FIG. 23). At a lower end of the swinging arm 71R, supporting holes 71RA at which the intermediate arm 72 is supported so as to be able to turn around an arm turning axis 71RJ are formed. For example, the swinging arm 71R is made of metal, such as aluminum.

As shown in FIG. 26, the intermediate arm 72 is an elongated member extending along the longitudinal direction of the thigh of the wearer. The intermediate arm 72 is an arm by which the swinging arm 71R and the rail 73 are connected to each other, and is made of resin, for example. At an upper end of the intermediate arm 72, a supporting hole 72A used to mount the intermediate arm 72 to the supporting holes 71RA of the swinging arm 71R is formed, and at a lower end of the intermediate arm 72, a cavity 72B into which an upper end portion of the rail 73 is fitted is formed.

As shown in FIG. 26, the rail 73 is an elongated member extending in a straight line along the longitudinal direction of the thigh of the wearer. For example, the rail 73 is made of metal, such as aluminum, and as shown in FIG. 27, supports the thigh-worn part 78R integrated with a sliding movable part 75R, so as to be able to slide in the longitudinal direction of the thigh of the wearer. The rail 73 has an inner surface 73M that is a surface on the side facing the thigh of the wearer, and an outer surface 73N that is a surface on the side opposite from the thigh of the wearer. Each of the inner surface 73M and the outer surface 73N has a channel-shaped part 73E (see FIG. 29) extending along the rail 73, along the longitudinal direction of the thigh of the wearer. Each channel-shaped part 73E has channel side surfaces 73A, 73B that are opposite surfaces, and a channel bottom surface 73C lying between the channel side surface 73A and the channel side surface 73B (see FIG. 26 and FIG. 29). The rail 73 has substantially an H-shape (the shape of the letter H) in cross section orthogonal to the longitudinal direction, and is both lightweight and strong like a so-called H-section. The rail 73 is hollow with a cavity 73D (see FIG. 29) to achieve a further weight reduction.

The cap 74 is made of resin, for example, and as shown in FIG. 26, has a cavity 74A into which a lower end portion of the rail 73 is fitted. As shown in FIG. 27, the cap 74 prevents the sliding movable parts 75, 75R (and the thigh-worn part 78R integrated with the sliding movable part 75R) that slide along the rail 73 from slipping out from the lower end of the rail 73.

Figure 28:
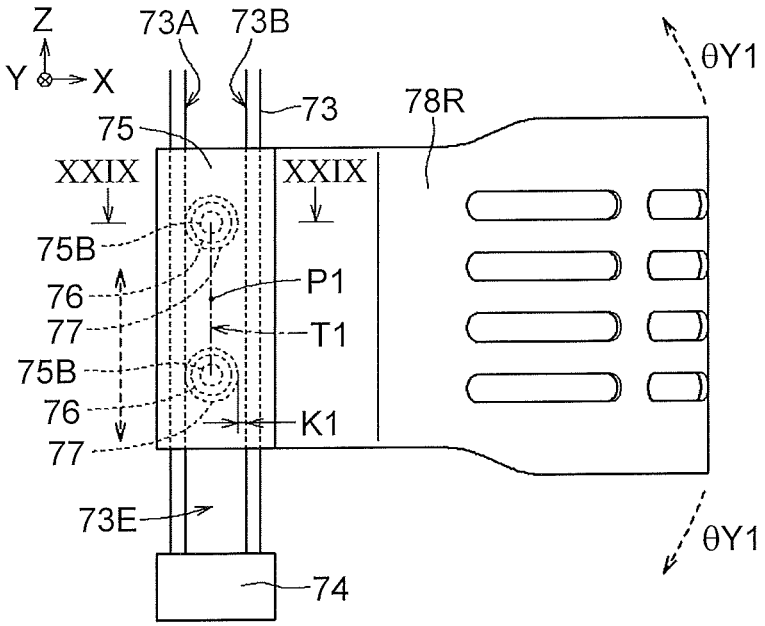
FIG. 28 is a view illustrating a state where sliding movable parts and the thigh-worn part slide along the rail.
Figure 29:
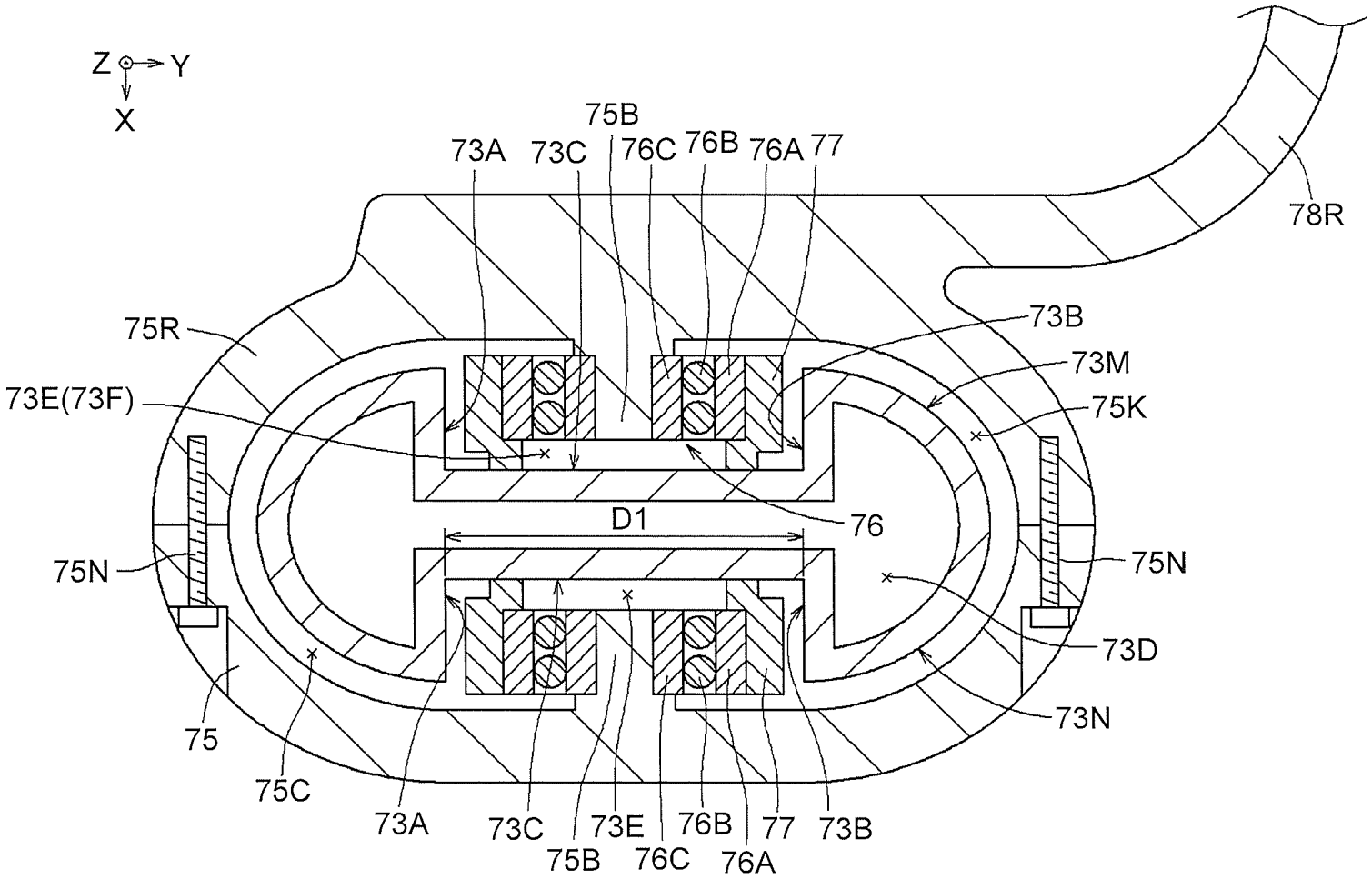
FIG. 29 is a sectional view taken along line XXIX-XXIX in FIG. 28.

As shown in FIG. 26 and FIG. 29, the sliding movable parts 75, 75R are disposed respectively on the side of the outer surface 73N of the rail 73 and on the side of the inner surface 73M of the rail 73. As shown in FIG. 29, the sliding movable parts 75, 75R are coupled together with fastening members 75N etc. and can slide along the longitudinal direction of the rail 73. When the sliding movable parts 75, 75R are coupled together, a through-hole 75C is formed at a center, and the rail 73 (see FIG. 28) is inserted into the through-hole 75C. In addition, supporting shafts 75B that support bearings 76 are provided on surfaces of the sliding movable parts 75, 75R that face the rail 73.

Figure 32:
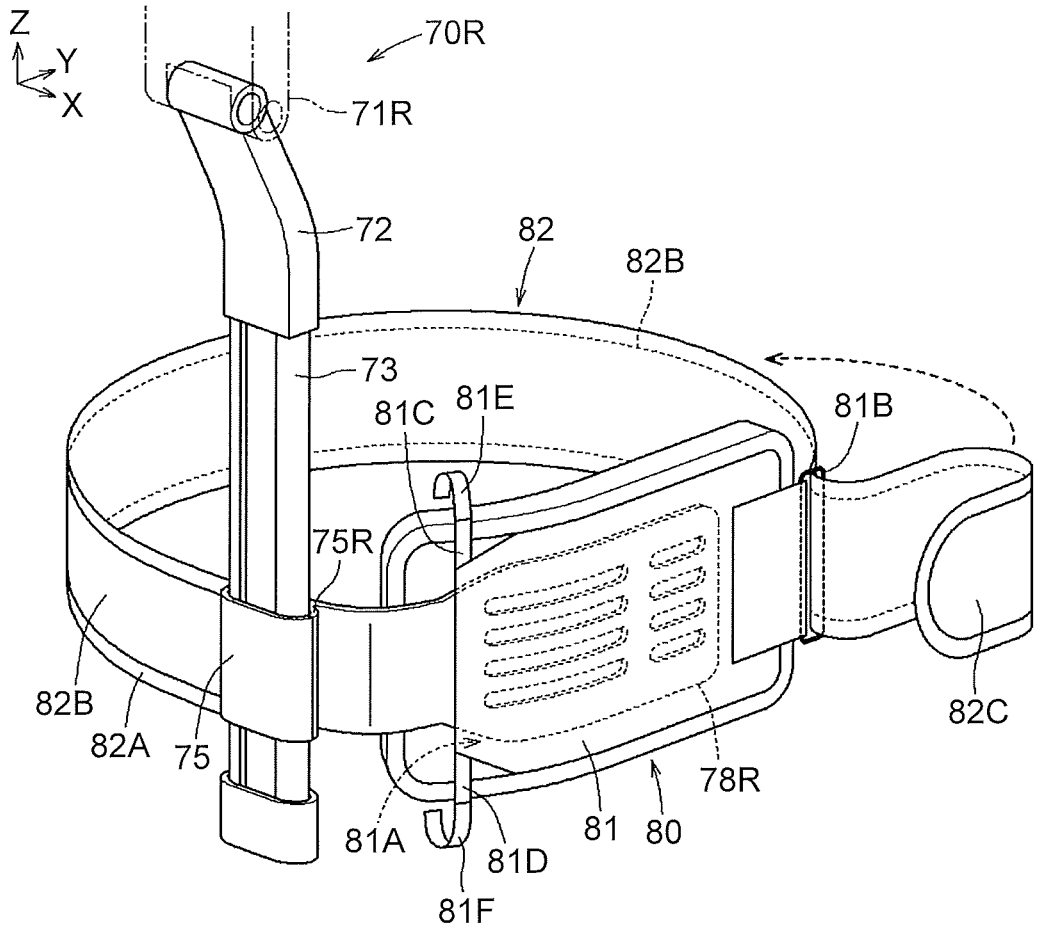
FIG. 32 is a perspective view illustrating a state where the thigh harness shown in FIG. 31 is mounted on the thigh-worn part of the link shown in FIG. 27.

As shown in FIG. 26 and FIG. 27, the thigh-worn part 78R has a thin plate shape, and has a mounting portion 78A that forms a portion connected to the sliding movable part 75R, and a worn portion 78B that is retained on the thigh of the wearer along with the thigh harness 80 as shown in FIG. 32 and FIG. 3. The thigh-worn part 78R may be integrated with at least a portion of the sliding movable part 75R as shown in FIG. 26, or may be formed as a part separate from the sliding movable part 75R and connected to the sliding movable part 75R with fastening members, such as screws.

As shown in FIG. 29, an inner ring 76C of the bearing 76 (that is a radial bearing and corresponds to a bearing roller) is fitted on an outer side of the supporting shaft 75B of the sliding movable part 75 disposed on the side of the outer surface 73N, and a roller 77 corresponding to a bearing roller) made of resin etc. is fitted on an outer side of an outer ring 76A of the bearing 76, bearing roller 76B being located between the inner ring 76C and the outer ring 76A.

As shown in FIG. 29, the thigh-worn part 78R is integrated with the sliding movable part 75R that is disposed on the side of the inner surface 73M. As shown in FIG. 29, an inner ring 76C of a bearing 76 (that is a radial bearing and corresponds to a bearing roller) is fitted on an outer side of the supporting shaft 75B of the sliding movable part 75R, and a roller 77 (corresponding to a bearing roller) made of resin etc. is fitted on an outer side of an outer ring 76A of the bearing 76. The sliding movable part 75R and the thigh-worn part 78R do not have to be integrated (may be separate parts).

As shown in FIG. 29, the outer rings 76A of the bearings 76 supported on the supporting shafts 75B do not come into contact with the sliding movable parts 75, 75R. As shown in FIG. 29, a distance Dl between the channel side surface 73A and the channel side surface 73B of the rail 73 is set to be slightly larger than the outside diameter of the roller 77, and a small clearance 75K is provided between inner peripheral surfaces of the sliding movable parts 75, 75R and an outer peripheral surface of the rail 73. In FIG. 29, the clearance in the Y-axis direction between the inner peripheral surfaces of the sliding movable parts 75, 75R and the outer peripheral surface of the rail 73 is set to be larger than the clearance in the Y-axis direction between the roller 77 and the channel side surfaces 73A, 73B.

Therefore, in FIG. 29, when the sliding movable parts 75, 75R shift leftward relative to the rail 73, the outer peripheral surfaces of the rollers 77 come into contact with the channel side surfaces 73A. (In this case, a clearance K1 is left between the rollers 77 and the channel side surfaces 73B as shown in FIG. 28.) When the sliding movable parts 75, 75R (see FIG. 27) then slide along the longitudinal direction of the rail 73, the rollers 77 in contact with the channel side surfaces 73A rotate and thereby reduce friction during sliding (see FIG. 28). Similarly, in FIG. 29, when the sliding movable parts 75, 75R shift rightward relative to the rail 73, the outer peripheral surfaces of the rollers 77 come into contact with the channel side surfaces 73B. When the sliding movable parts 75, 75R then slide along the longitudinal direction of the rail 73, the rollers 77 in contact with the channel side surfaces 73B rotate and thereby reduce friction during sliding.

The channel-shaped part 73E at one side of the rail 73 faces the thigh of the wearer, and this channel-shaped part 73E (the channel-shaped part facing the thigh of the wearer) will be referred to as a thigh-side channel-shaped part 73F (see FIG. 26). In the example shown in FIG. 28, two bearings 76 and two rollers 77 are disposed along the longitudinal direction of the rail 73, on the inner wall surface of the sliding movable part 75R facing the thigh-side channel-shaped part 73F (see FIG. 26). In this case, as shown in FIG. 28, the two bearings 76 and the two rollers 77 are housed inside the channel-shaped part 73E of the rail 73 (inside the thigh-side channel-shaped part 73F). When the thigh-worn part 78R turns around a point P1 on an imaginary straight line T1 connecting centers of the two bearings 76, the two rollers 77 interfere with the channel side surfaces 73A, 73B, resulting in a relatively small allowable turning angle θY1 of the thigh-worn part 78R. In the example of FIG. 28, two bearings 76 and two rollers 77 are disposed along the longitudinal direction of the rail 73, between each of the two channel-shaped parts 73E of the rail 73, one on the side facing the thigh and the other on the side opposite from the thigh, and each of the inner wall surfaces of the sliding movable parts 75, 75R facing the respective channel-shaped parts 73E. However, two or more bearings 76 and two or more rollers 77 may be disposed. Compared with when one bearing roller is provided, this can make the allowable turning angle θY1 of the thigh-worn part relative to the rail smaller, so that the thigh-worn part that can slide relative to the rail can be maintained in a more stable posture.

Figure 30:
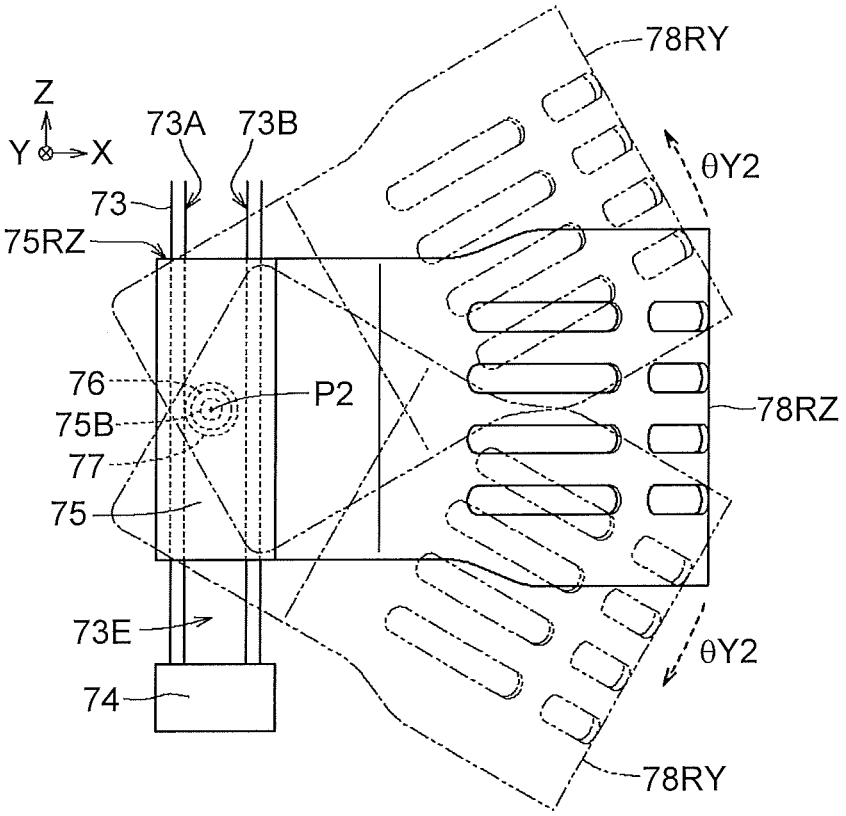
FIG. 30 is a view illustrating a state where the thigh-worn part is connected at one point to the sliding movable parts so as to be able to rotate relative to the sliding movable parts relative to FIG. 28.

By contrast, in the example shown in FIG. 30, one bearing 76 and one roller 77 are disposed on an inner wall surface of a sliding movable part 75RZ facing the thigh-side channel-shaped part 73F (see FIG. 26). In the example of FIG. 30, one bearing 76 and one roller 77 are disposed between each of the two channel-shaped parts 73E of the rail 73, one on the side facing the thigh and the other on the side opposite from the thigh, and each of the inner wall surfaces of the sliding movable parts 75, 75RZ facing the respective channel-shaped parts 73E. When the thigh-worn part 78RZ turns around a point P2 that is a center of the one bearing 76, the one roller 77 does not interfere with the channel side surfaces 73A, 73B, and the thigh-worn part 78RZ can turn until the sliding movable part 75RZ integrated with the thigh-worn part 78RZ interferes with the rail 73. Thus, an allowable turning angle θY2 shown in FIG. 30 is larger than the allowable turning angle θY1 in the case of FIG. 28. In a situation where a posture of the thigh-worn part turned to a greater degree relative to the rail is preferred according to various motions of the thighs of the wearer, such as the state of the wearer at various forward leaning angles, the state of the right and left legs in the front-rear direction, or the state of opening thereof, such a large allowable turning angle allows the thigh-worn part to turn automatically so as to appropriately follow the wearer's motion.

If the sliding movable part 75R and the thigh-worn part 78R are not integrated and a separate thigh-worn part 78RY is provided, and the separate thigh-worn part 78RY is coupled at one point to the sliding movable part 75R, the allowable turning angle of the thigh-worn part 78RY can be made even larger.

In a case such as when the arm swings with the position of the swinging axis thereof (imaginary turning axis 11J) and the position of the hip joint of the wearer not coinciding with each other, or when the wearer opens his or her legs sideways, the thigh-worn part slides automatically to an appropriate position, so that assisting torque can be efficiently transmitted, and an appropriate worn state can be maintained without causing the wearer to feel discomfort or pain. In addition, friction and noise occurring during sliding of the thigh-worn part can be reduced by the bearing roller.

Figure 31:
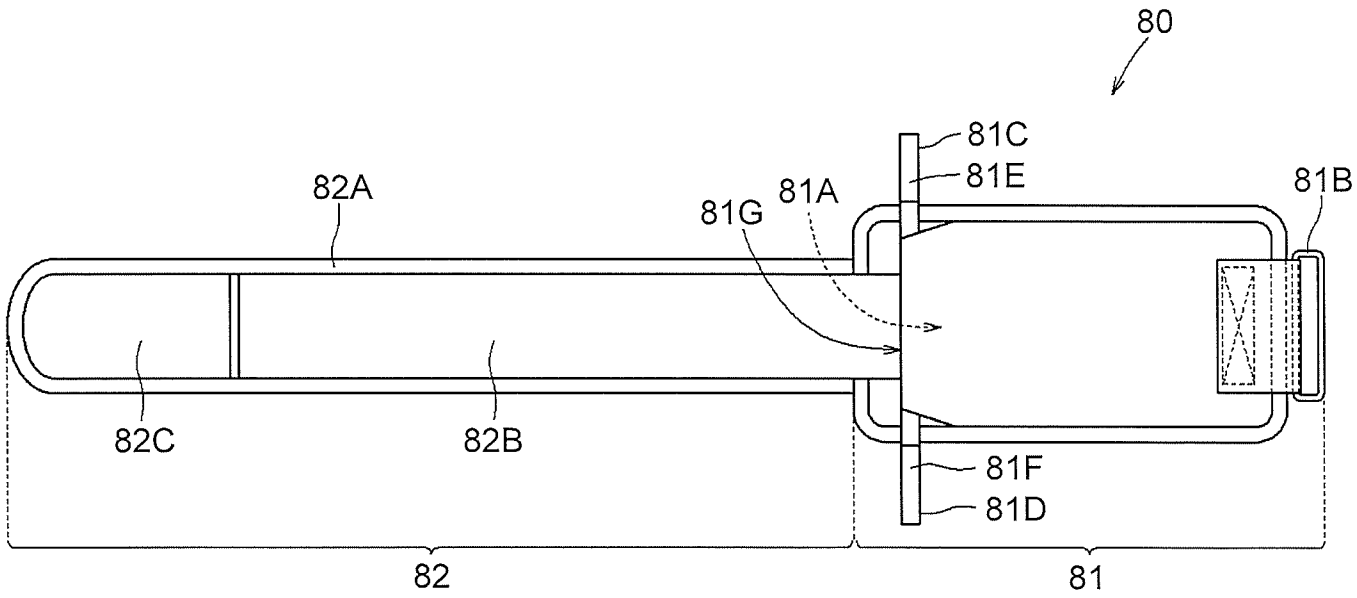
FIG. 31 is a view illustrating the structure of a thigh harness.

Next, the structure etc. of the thigh harness 80 will be described using FIG. 31 and FIG. 32. As shown in FIG. 31, the thigh harness 80 has the cover 81 and the belt 82.

As shown in FIG. 32, the cover 81 is formed as a pocket 81A to house the thigh-worn part 78R (or the thigh-worn part 78L), and the thigh-worn part 78R (or the thigh-worn part 78L) is inserted into the pocket 81A through a pocket insertion opening 81G (see FIG. 31). For example, a layer of a three-dimensional mesh having elasticity is disposed on a surface of the cover 81 at the side closer to the thigh of the wearer, and two sheets of nylon cloth are laid over this three-dimensional mesh, and the part between these two sheets of nylon cloth is formed as the pocket 81A.

A ring 81B (see FIG. 32) into which the belt 82 wound around the thigh of the wearer is inserted is provided at the side of the cover 81 opposite from the belt 82. Retaining belts 81C, 81D that prevent the thigh-worn part 78R (or the thigh-worn part 78L) housed inside the pocket 81A from slipping out of the pocket 81A are provided at the side of the cover 81 closer to the belt 82. For example, a touch-and-close fastener 81E (hook side) is mounted on the retaining belt 81C, and a touch-and-close fastener 81F (loop side) is mounted on the retaining belt 81D. When the touch-and-close fastener 81E (hook side) and the touch-and-close fastener 81F (loop side) are laid over each other, the thigh-worn part 78R (or the thigh-worn part 78L) housed inside the pocket 81A is retained so as not to slip out of the pocket 81A.

A portion of the belt 82 at which the belt 82 is connected to the cover 81 is mounted on the cover 81, between the three-dimensional mesh and the nylon cloth closer to the three-dimensional mesh. For example, a nylon belt 82A is disposed on a surface of the belt 82 at the side closer to the thigh of the wearer, and a touch-and-close fastener 82B (loop side) or a touch-and-close fastener 82C (hook side) is laid over the nylon belt 82A along the longitudinal direction of the belt 82. In an area of the belt 82 closer to an end on the side opposite from the cover 81 (leading end), the touch-and-close fastener 82C (hook side) is provided, and the touch-and-close fastener 82B (loop side) is provided in the rest of the surface.

As shown in FIG. 32, the wearer first inserts the thigh-worn part 78R into the pocket 81A of the cover 81 of the thigh harness 80. Then, the wearer winds the belt 82 around his or her thigh and inserts the leading end of the belt 82 into the ring 81B and turns back the belt 82, and puts the touch-and-close fastener 82C (hook side) at the leading end of the belt 82 over the touch-and-close fastener 82B (loop side) of the belt 82 to fix the belt 82. Then, the wearer winds the retaining belts 81C, 81D around the thigh-worn part 78R having been inserted into the pocket 81A, and puts the touch-and-close fastener 81E (hook side) over the touch-and-close fastener 81F (loop side) to fix the retaining belts 81C, 81D. Thus, the wearer can retain the thigh-worn part 78R on his or her thigh by an extremely simple procedure. Since the thigh-worn part 78R can slide along with the thigh harness 80 in the longitudinal direction of the rail 73, the thigh-worn part 78R and the thigh harness 80 can be conveniently moved to an appropriate position in response to various motions of the wearer.

Various modifications, additions, and omissions can be made to the structure, configuration, form, external appearance, operation, etc. of the power assist suit 1 of the present disclosure within such a range that the gist of the disclosure is not changed. While the example in which the spiral spring 55 (see FIG. 20) is used has been described in the embodiment, a torsion bar or a torsion bar spring may be used instead of a spiral spring.

Numerical values used in the description of the embodiment are merely examples, and the present disclosure is not limited to these numerical values. Signs such as "or more (≥)", "or less (≤)", "larger than (>)", and "smaller than (<)" may or may not include an equal mark.

What is claimed is:

1. A power assist suit comprising:

a harness configured to be worn at least around hips of a wearer;

an assist unit configured to be worn on the harness and a thigh of the wearer, the assist unit being configured to assist a predetermined motion, the predetermined motion being at least either a motion of the thigh relative to the hips of the wearer or a motion of the hips relative to the thigh of the wearer;

a power unit configured to generate assisting torque to be transmitted to the assist unit; and a first bearing and a second bearing, each of the first bearing and the second bearing including an inner ring and an outer ring, wherein the assist unit includes an arm that is configured to swing by the assisting torque and a thigh-worn part that is configured to be worn on the thigh of the wearer, the arm has an elongated shape extending from a side part of the hips of the wearer along a side part of the thigh of the wearer, and a rail is provided at a part of the arm in a longitudinal direction, the rail has an H-shape in cross section orthogonal to the longitudinal direction and includes first and second channel-shaped parts extending along the longitudinal direction, each of the first and second channel-shaped parts including first and second channel side surfaces opposite each other and a bottom surface between the first and second channel side surfaces, the thigh-worn part is connected to sliding movable parts or integrated with at least a portion of the sliding movable parts, and the sliding movable parts are configured to slide along the longitudinal direction of the rail and each including a supporting shaft provided on a surface of the sliding movable part facing the rail, and the first and second bearings are respectively disposed in the first and second channel-Shaped parts with the inner ring of each of the first bearing and the second bearing being fitted on the supporting shaft of the sliding movable parts, and a roller being fitted on the outer ring of each of the first bearing and the second bearing, the outer rings of the first bearing and the second bearing being free of contact with the sliding movable parts.

2. The power assist suit according to claim 1, further comprising a third bearing and a fourth bearing, the third bearing being disposed along the longitudinal direction from the first bearing, and the fourth bearing being disposed along the longitudinal direction from the second bearing.

3. The power assist suit according to claim 1, wherein:

the assist unit includes an idler pulley;

the power unit includes a drive pulley and an actuator; and the assisting torque generated by the actuator is transmitted from the drive pulley to the idler pulley through a cable, and a drive pulley shaft member forming a shaft of the drive pulley is supported, inside the power unit, at both ends in a direction of a drive pulley rotational axis that is a rotational axis of the drive pulley.

4. The power assist suit according to claim 3, wherein the drive pulley and the idler pulley are disposed such that the drive pulley rotational axis and an idler pulley rotational axis that is a rotational axis of the idler pulley are not parallel to each other.

5. The power assist suit according to claim 3, wherein:

the power unit has a cable hole into which the cable drawn out of the drive pulley is inserted; and a cable guide that guides the cable drawn out of the drive pulley to the cable hole in a straight line is provided inside the power unit.

6. The power assist suit according to claim 1, wherein a distance between the first and second channel side surfaces is greater than an outside diameter of the roller.

* * * * *